US011773672B2

(12) United States Patent
Kalb et al.

(10) Patent No.: US 11,773,672 B2
(45) Date of Patent: Oct. 3, 2023

(54) DEBRIS EXCLUSIVE-PRESSURE INTENSIFIED-PRESSURE BALANCED SETTING TOOL FOR LINER HANGER

(71) Applicant: Weatherford Technology Holdings, LLC, Houston, TX (US)

(72) Inventors: Frank D. Kalb, Cypress, TX (US); Eric D. Alonzo, Tomball, TX (US); Alexey Petrenko, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 29 days.

(21) Appl. No.: 17/386,177

(22) Filed: Jul. 27, 2021

(65) Prior Publication Data

US 2023/0033711 A1 Feb. 2, 2023

(51) Int. Cl.
*E21B 23/04* (2006.01)
*E21B 43/10* (2006.01)

(52) U.S. Cl.
CPC ..... *E21B 23/0413* (2020.05); *E21B 23/04* (2013.01); *E21B 23/0411* (2020.05); *E21B 23/0412* (2020.05); *E21B 43/10* (2013.01)

(58) Field of Classification Search
CPC .. E21B 23/04; E21B 23/0411; E21B 23/0412; E21B 23/0413; E21B 43/10
See application file for complete search history.

(56) References Cited

U.S. PATENT DOCUMENTS 4,583,593 A * 4/1986 Zunkel ..... E21B 43/10 166/131
4,928,541 A * 5/1990 Toon ..... E21B 49/082 73/864.81
5,038,860 A 8/1991 Baugh et al.
6,065,536 A 5/2000 Gudmestad et al.
7,114,573 B2 10/2006 Tirth et al.
(Continued)

FOREIGN PATENT DOCUMENTS

GB 2229753 A 3/1990

OTHER PUBLICATIONS

Weatherford. "Weatherford Premium Hydraulic-Rotating (WPHR) Liner Hanger." Liner Systems, 2006-2011 Weatherford. 2 pages.
(Continued)

*Primary Examiner* — Nicole Coy
*Assistant Examiner* — Nicholas D Wlodarski
(74) *Attorney, Agent, or Firm* — Cabello Hall Zinda, PLLC

(57) ABSTRACT

A system and method set a liner hanger in a borehole by actuating a hydraulic setting mechanism on the hanger to engage slips in the borehole. A setting tool runs the hanger into position. A reserve volume of the tool holds a clean fluid separate from the borehole. A piston of the tool has a tool volume for the fluid. During run in, pressure in the tool volume is balanced to hydrostatic pressure by drawing actuation fluid from the reserve volume to the tool volume through a check valve. To set the hanger, a plug is engaged on a seat in the tool, tubing pressure is applied behind the engaged plug, and the seat is unlocked. With more applied pressure, the piston moves, reduces the tool volume, and intensifies pressure of the clean fluid communicated to the hanger's setting mechanism. Over-pressure can be handled by a venting valve.

20 Claims, 16 Drawing Sheets

(56) References Cited

U.S. PATENT DOCUMENTS

| | | | | |
|---|---|---|---|---|
| 9,518,452 | B2 | 12/2016 | Turley et al. | |
| 10,030,480 | B2 | 7/2018 | Reinhardt et al. | |
| 10,907,428 | B2 | 2/2021 | Luke et al. | |
| 2013/0118758 | A1* | 5/2013 | Caminari | E21B 34/10 166/373 |
| 2015/0136393 | A1 | 5/2015 | Turley et al. | |
| 2021/0115757 | A1 | 4/2021 | Murray et al. | |

OTHER PUBLICATIONS

Weatherford. "WRSM Retrievable Cementing Packoff." Liner Systems, 2019 Weatherford. 2 pages.

Weatherford. "WRSM Retrievable Cementing Packoff Delivers High-Pressure Performance Saves Half Day of Rig Time." Liner Systems/Running Tools and Accessories. 2015 Weatherford. 1 page.

Weatherford. "WTSP4R1 Liner-Top Packer with R Running Tool Profile 9-5/8 x 11-3/4 in. and 11-3/4 x 13-3/8 in." Liner Systems. 2008-2011 Weatherford. 2 pages.

International Search Report from PCT/US2022/035606, dated Sep. 30, 2022.

* cited by examiner

DEBRIS EXCLUSIVE-PRESSURE INTENSIFIED-PRESSURE BALANCED SETTING TOOL FOR LINER HANGER

BACKGROUND OF THE DISCLOSURE

During completion operations, a setting tool is used for deploying and setting a liner hanger system downhole. The drilling fluid in some downhole environments may be heavily laden drilling fluid of about 20 lbf/gal (ppg). A major weighting component in the drilling fluid is barite, which has the tendency to sag or deposit in low flow velocity and low-pressure gradient areas within the fluid column. When setting a liner hanger in this fluid environment, the deposited barite tends to accumulate in areas around a hydraulic setting cylinder used to set the slips of the liner hanger. This accumulation of barite tends to increase the actuation pressure required from the setting tool to move and set the slips of the liner hanger.

The barite can also adversely affect the setting tool. In particular, the debris-laden drilling fluid has the tendency to deposit debris into the workings of the tool's setting mechanisms, which interferes with the actuation of the setting of the liner hanger. Additionally, drilling fluid is traditionally used as the working fluid to pressurize a hydraulic setting cylinder of the liner hanger to set the slips. When such debris-laden fluid is used, there is an increased potential to foul the setting tool and the internal pressure volume of the liner hanger.

Although existing techniques may be useful and effective, the subject matter of the present disclosure is directed to overcoming, or at least reducing the effects of, one or more of the problems set forth above.

SUMMARY OF THE DISCLOSURE

According to the present disclosure, a setting tool is used on tubing and is activated by applied tubing pressure behind a deployed plug to set a liner hanger in a borehole. The liner hanger has a hanger bore with at least one inlet port. The at least on inlet port is disposed in fluid communication with a hydraulic setting mechanism for the liner hanger. The setting tool comprises: a tool body, a bonnet, an actuator piston, a check valve, and an actuator seat.

The tool body is disposed on the tubing and has a tool bore for borehole fluid. A stinger portion of the tool body is configured to seal inside the hanger bore and has at least one outlet port, which is disposed in fluid communication with the at least one inlet port. The bonnet is disposed on the tool body and contains a first volume configured to hold an activation fluid separate from the borehole fluid.

The actuator piston is disposed in the tool bore and has a second volume defined therewith. The second volume is configured to hold the actuation fluid, and the at least one outlet port communicates the second volume with the at least one inlet port of the hanger. The check valve is disposed on the tool body and is configured to communicate the actuation fluid from the first volume to the second volume.

The actuator seat is associated with the actuator piston and is configured to engage the deployed plug. The actuator piston is configured to move in response to the applied tubing pressure behind the deployed plug engaged in the actuator seat. In response to the movement, the actuator piston is configured to intensify the applied tubing pressure on the actuation fluid in the second volume to the hydraulic setting mechanism for the liner hanger.

According to the present disclosure, a method of setting a liner hanger in a borehole is disclosed. The liner hanger has a hydraulic setting mechanism. The method comprises: running the liner hanger into position in the borehole by using a setting tool disposed on tubing, the setting tool having a first volume with an actuation fluid separate from the borehole fluid, the setting tool having an actuator piston with a second volume for the actuation fluid; balancing pressure in the second volume to hydrostatic pressure in the borehole by drawing the actuation fluid from the first volume to the second volume; engaging a plug in the tubing on an actuator seat in the setting tool; applying tubing pressure behind the engaged plug in the actuator seat; moving the actuator piston in the setting tool in response to the applied tubing pressure behind the engaged plug; and intensifying the applied tubing pressure to an intensified pressure of the actuation fluid in the second volume of the actuator piston and communicating the intensified pressure to the hydraulic setting mechanism of the liner hanger.

The foregoing summary is not intended to summarize each potential embodiment or every aspect of the present disclosure.

DETAILED DESCRIPTION OF THE DISCLOSURE

Figure 1A:
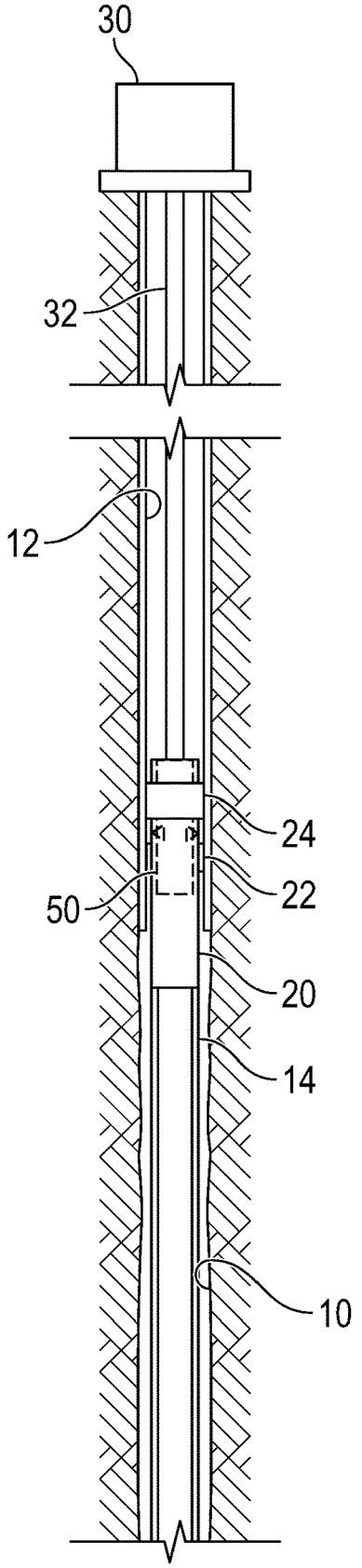
FIGS. 1A-1B illustrate schematic views of a setting tool deploying and setting a liner hanger system according to the present disclosure.

FIG. 1A illustrates a schematic view of a setting tool 50 deploying and setting a liner hanger 20 according to the present disclosure. As shown in FIG. 1A, a borehole 10 has casing 12 in which the liner hanger 20 is being deployed with the setting tool 50 to hang a liner 14.

Figure 1B:
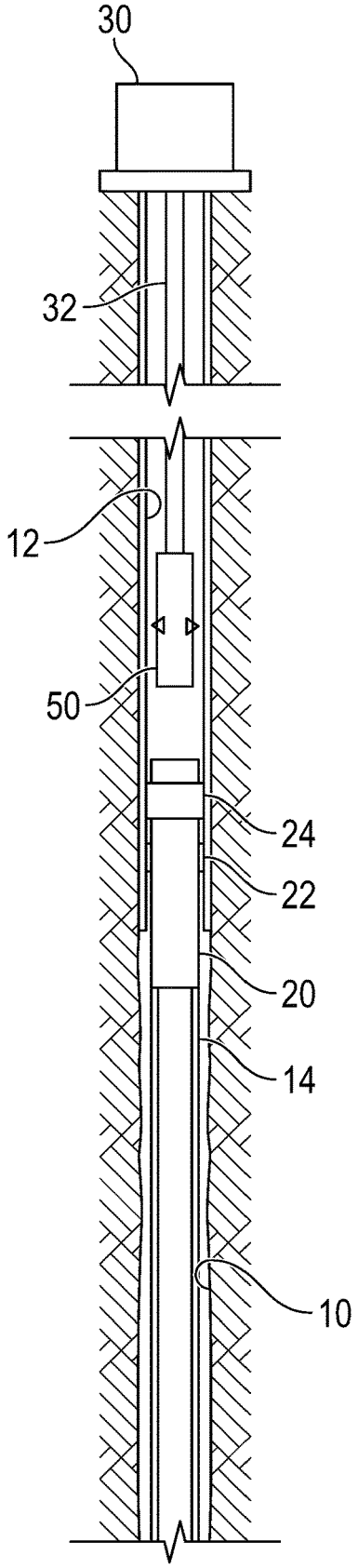

The setting tool 50 is connected to a running string 32 from the surface/rig deck/rig drawworks or the like. The running string 32 is run through a wellhead 30 and runs in the liner 14 and the liner hanger 20 through the casing 12. When the proper depth is reached, the setting tool 50 activates the liner hanger 20 by setting slips 22 and a packing element 24 so the liner 14 extends into the open borehole 10. The setting tool 50 of the present disclosure allows the liner hanger 20 to be run and set in downhole environments having a heavy, debris-laden drilling fluid, which would typically interfere with setting the liner hanger 20 as noted above. As shown in FIG. 1B, after setting the liner 14 and hanger 20, the setting tool (50) is released from the liner hanger system so additional operations can follow, such as cementing the liner 14 in the open borehole 10.

Figure 2:
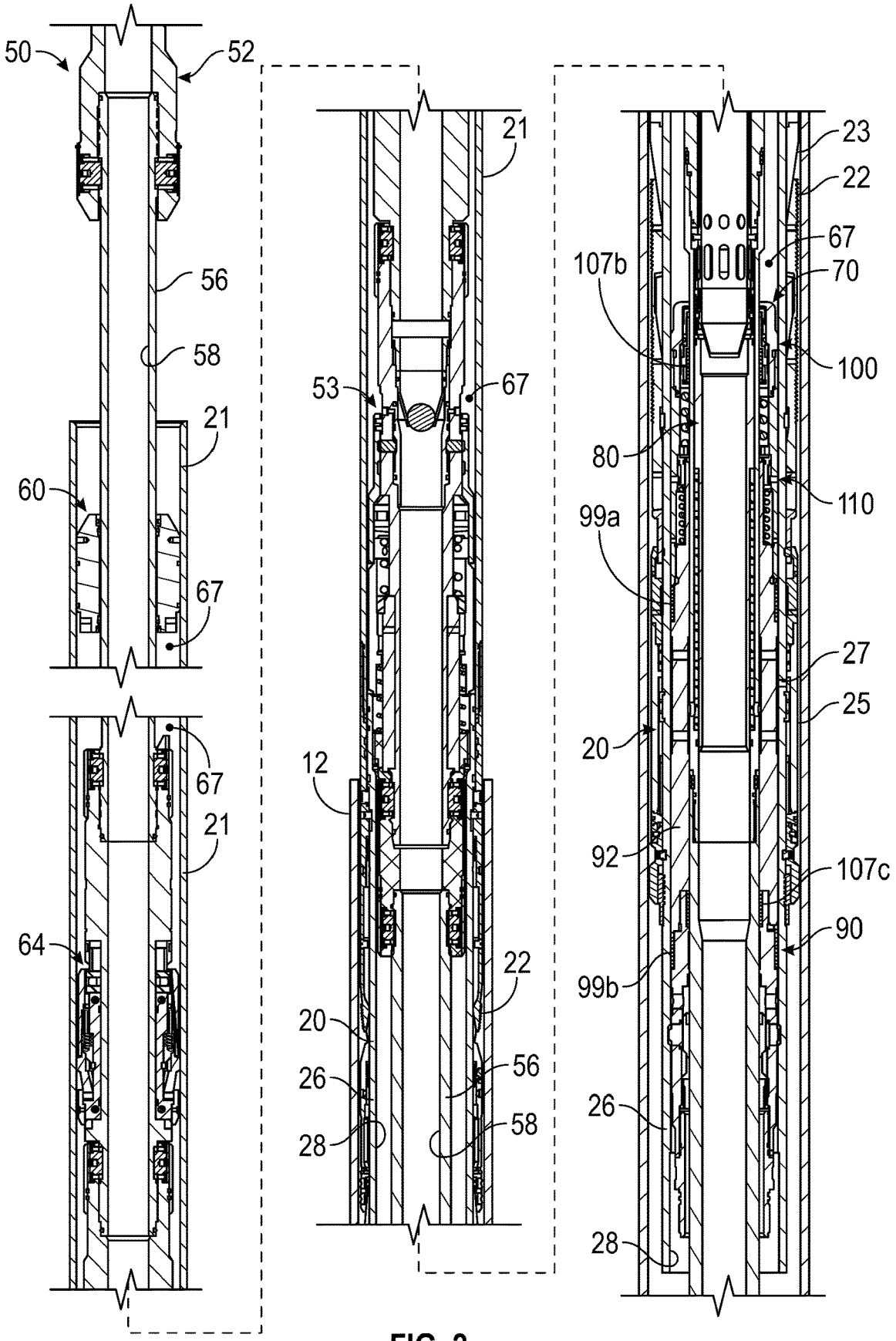
FIG. 2 illustrates a cross-sectional view of a setting tool according to the present disclosure for deploying and setting a liner hanger system.

FIG. 2 illustrates a cross-sectional view of the setting tool 50 according to the present disclosure for deploying and setting a liner hanger 20. Briefly, the liner hanger 20 includes a mandrel 26 having a flow bore 28 therethrough. A hydraulic setting piston 25 (or other hydraulic setting mechanism) on the mandrel 26 can be hydraulically activated by fluid communication through a flow port 27 in the mandrel 26. The activated piston 25 pushes slips 22 on the mandrel 26 against cones 23 so that the slips 22 can engage inside the casing 12. As also shown, the hanger 20 has a polished bore receptacle 21 attached to the upper end of the mandrel 26. Although not shown in FIG. 2, the downhole end of the liner hanger 20 supports a liner (14).

Briefly, the setting tool 50 includes a body 56 having a flow bore 58 therethrough from an uphole end 52 to a downhole end 54. As is typical but now shown, the uphole end 52 connects to a tubing string for running the setting tool 50 and liner hanger 20. The downhole end 54 can have additional tubing that includes a coupler for attaching additional component and that includes a pickup spacer (not shown) for removing components of the setting tool 50 from inside the hanger 20 during retrieval as discussed below. The flow bore 58 allows running fluid to pass through the setting tool 50 during run-in operations so that circulation can be provided as the liner (14) and hanger 20 are run through the borehole (10).

A stinger portion of the tool body 56 uses a pack-off assembly 90 to seal inside the hanger bore 28 so at least one outlet port (not labelled in FIG. 2) on the tool body 56/pack-off assembly 90 is disposed in fluid communication with at least one inlet port 27 of the liner hanger's hydraulic setting piston 25.

In addition to these elements, the setting tool 50 includes a floating junk bonnet 60, a packer actuator 64, a release mechanism 53, a locking mechanism 70, a slick stinger actuator 80, a pressure-balancing check valve assembly (i.e., balancing check valve 100), and an over-pressure venting assembly (i.e., venting valve 110).

The floating junk bonnet 60 is disposed on the tool body 56 and defines a first reserve volume 67 configured to hold an activation fluid separate and different from the borehole fluid. The floating junk bonnet 60 prevents drilling fluid from being introduced in to an annular area of the inner bore 28 of the liner hanger mandrel 26/polished bore receptacle 21 and the outside surface of the setting tool's components. In conjunction with the floating junk bonnet 60, the pack-off assembly 90 isolates the hydraulic setting port 27 of the liner hanger 20 from the drilling fluids above and below it. The fluid above the pack-off assembly 90 is isolated from drilling fluid by the bonnet 60, and pack-off seals 99*a-b* and 99*c-d* on a body 92 of the pack-off assembly 90 isolates the setting port 27. This is part of the debris exclusion achieved by the setting tool 50.

Figure 3A:
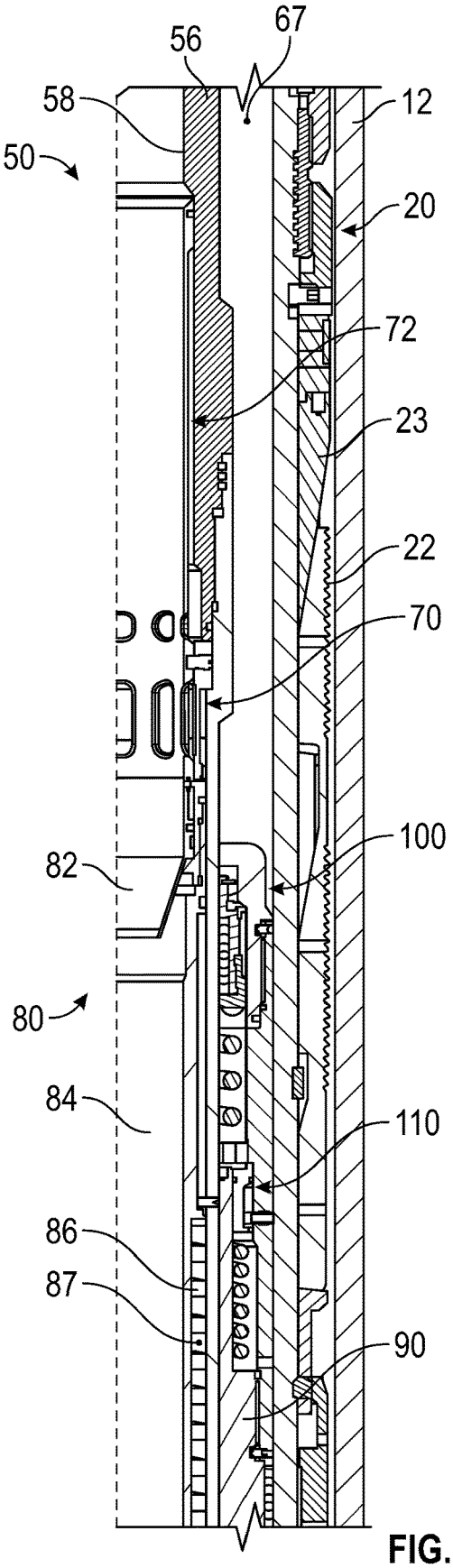
FIGS. 3A-3B illustrate cross-sectional views of detailed portions of the disclosed setting tool.
Figure 3B:
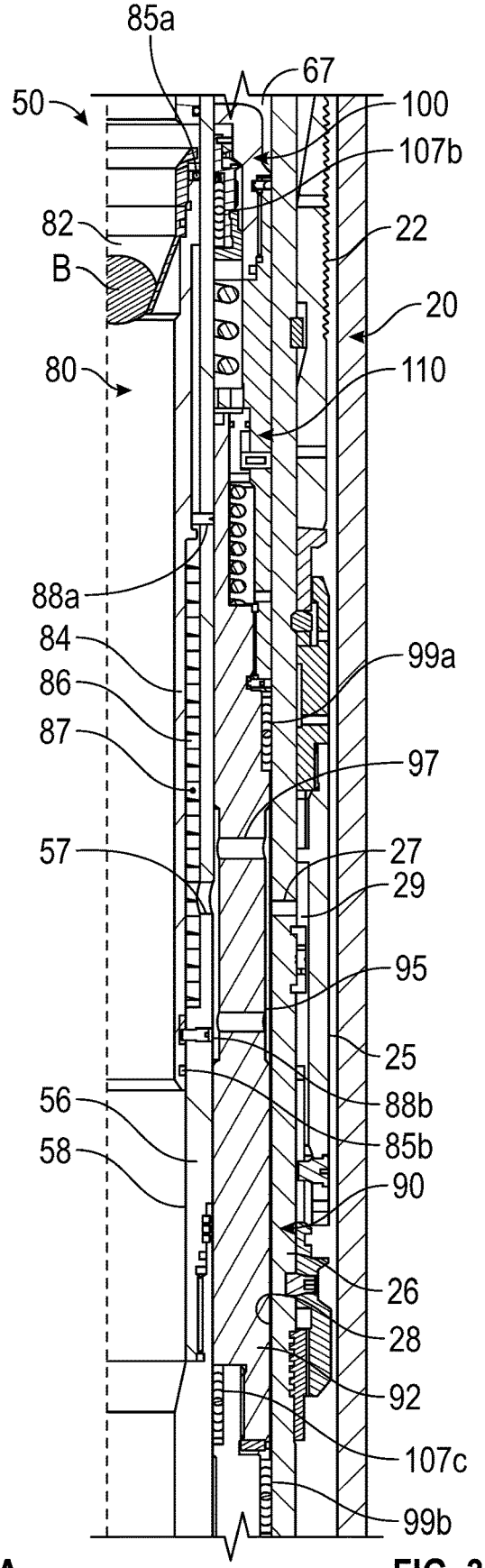

Looking at further details of the setting tool 50, FIGS. 3A-3B illustrate cross-sectional views of detailed portions of the setting tool 50, including the locking mechanism 70, the actuator 80, portion of the pack-off assembly 90, the balancing check valve 100, and the venting valve 110 relative to the liner hanger 20 in the casing 12. The setting tool 50 includes debris exclusion feature, pressure-intensifying features, and pressure-balancing features.

The locking mechanism 70 of the setting tool 50 allows for high circulation rates without wear or premature setting of the liner hanger 20. In particular, the setting tool 50 can withstand high-flow and circulation rates because the locking mechanism 70 prevents any unintentional movement of the actuator piston 84 until the system is unlocked and it is desired to set the system. Using of the locking mechanism 70, the setting tool 50 can also withstand open-hole pack-off situations where circulation flow is suddenly stopped and wellbore pressure increases. The pressure increase without the locking mechanism 70 in place could cause the actuator piston 84 to actuate due to the differential piston surfaces that are on the actuator piston 84. With the locking mechanism 70 in place, however, the actuator piston 84 is held in place to internal pressures well above 10,000-psi. Pack-off pressure is not allowed to achieve such a magnitude because well formation damage would likely occur.

The slick stinger actuator 80 includes an actuator seat 82 and an actuator piston 84 disposed in the tool bore 58. The actuator seat 82 is associated with the actuator piston 84 and is configured to engage the deployed plug B. The actuator piston 84 has a second (tool) volume 87 configured to hold the actuation fluid. The outlet ports 57, 97 on the tool body 56/pack-off body 92 communicate the tool volume 87 with the inlet port(s) 27 of the hanger 20.

During general operation disclosed in more detail below, the setting tool 50 runs the liner hanger 20 to depth in the casing 12. The actuation fluid from the reserve volume 67 of the bonnet (60) is drawn through the balancing check valve 100 to the tool volume 87 to balance pressure inside the setting tool 50 with the increasing hydrostatic pressure. The check valve 100 disposed on the tool body 56 is configured to communicate the actuation fluid from the reserve volume 67 of the bonnet 60 to the tool volume 87, but to prevent reverse communication.

In this way, the balancing check valve 100 is employed to allow for a hydrostatic response of the floating junk bonnet 60 to transfer hydrostatic pressure to the tool volume 87 of the tool 50, which in turn communicates with an isolated annular volume 95 of the pack-off assembly 90. This ensures that the pressure effect of the drilling fluid weight and depth are not a pressure/load factor that must be overcome with applied setting pressure from the setting tool 50 for the liner hanger 20. Thus, the tool 50 can become pressure-balanced to the hydrostatic pressure. As the setting tool 50 and liner hanger 20 are run in hole to depth, the effect of the hydrostatic pressure equalizes all internal and external components and features without the introduction of debris and weighted drilling fluids.

When ready to set the liner hanger 20, operators deploy a plug (e.g., drop ball B) down the tubing string to the seat 82 of the actuator 80. Tubing pressure is applied behind the seated plug B, and the locking mechanism 70 is unlocked. Then, the actuator piston 84 is sheared free and is moved. The actuator piston 84 in response to the movement intensifies the applied tubing pressure on the actuation fluid in the tool volume 87 communicated to the hydraulic setting piston 25 for the liner hanger 20. This allows the setting slips 22 of the liner hanger 20 to engage inside the casing 12.

Having a general understanding of the setting tool 50 and its operation, some of the benefits are now noted. For instance, the setting tool 50 can be particularly useful for deploying and setting the liner hanger 20 in downhole environments having a heavy, debris-laden drilling fluid, such as 20 lbf/gal (ppg). As noted previously, a major weighting component in the drilling fluid can be barite, which has the tendency to sag or deposit in low flow velocity and low-pressure gradient areas within the fluid column.

The setting tool 50 of the present disclosure can mitigate issues encountered when setting the liner hanger 20 in such an environment. In particular, the setting tool 50 can overcome the resistance caused by deposits that accumulate in areas around the hydraulic setting piston 25 used to set the slips 22 of the hanger 20. This disclosed setting tool 50 provides the required actuation pressure from the setting tool 50 to move and set the slips 22 by intensifying the pressure applied by the tubing pressure behind the seated plug B. Additionally, the inner workings of the setting tool's setting mechanism are kept free of the debris-laden drilling fluid to mitigate interference of the fluid with the actuation of the setting of the liner hanger 20 and to avoid fouling the setting tool 50 and the internal pressure volume 29 of the liner hanger 20.

Overall, the disclosed setting tool 50 minimizes contact with the drilling fluid, which reduces operational risk for setting the liner hanger 20 and potential non-productive time (NPT). As will be appreciated, the liner hanger 20 will be exposed externally to the drilling fluid, but the internal actuation fluid and the means to deliver the pressurize fluid via the setting tool 50 are not contaminated or compromised by detrimental debris.

Additional debris exclusion for the setting tool 50 is achieved by isolating the actuator piston 84, which is part of the slick stinger 80 of the setting tool 50. The slick stinger's piston 84 acts as a sealing sleeve that provides debris and pressure isolation during cementing operations during the liner hanger 50 installation. The slick stinger actuator 80 provides pressure control while transitioning to a packer setting position after cementing. However, prior to any of these functions, the slick stinger actuator 80 houses setting mechanisms required to actuate and provide isolated setting pressure to the hydraulic setting piston 25 of the liner hanger 20.

The actuator piston 84 in the slick stinger actuator 80 is isolated from the drilling fluid by seals 85*a-b*. In this way, the actuator piston 84 can prevent the drilling fluid from being introduced into the clean fluid inside the tool volume 87. The clean setting fluid, which is used as part of the fluid volume from the pack-off assembly 90, is fed from the balancing check valve 100. The setting fluid is completely isolated from external dirty fluids, and only clean fluids are introduced into the liner hanger setting port 27 and hydraulic chamber 29 of the hydraulic setting piston 25 during the setting operation.

The disclosed setting tool 50 also excludes annular wellbore fluids by using the floating junk bonnet 60 and by isolating the tool volume 87 using the pack-off assembly 90. Additionally, to exclude debris, the intensifying actuator piston 84 uses clean fluid from the volumes 67, 87 of the bonnet 60 and the actuation mechanism. The actuator piston 84 does not introduce contaminated, dirty wellbore fluids into the hydraulic setting piston 25 of the liner hanger 20.

The disclosed setting tool 50 is pressure-balancing because the setting tool 50 is always hydrostatically balanced via the balancing check valve 100 on the pack-off assembly 90. This ensures that only relative pressures above the hydrostatic pressure reference may be applied to set the liner hanger 20.

In one configuration, the intensifying actuator piston 84 of the setting tool 50 can provide a power ratio of 3.6 to 1, multiplying the applied tubing pressure by almost 4 time to produce a setting pressure that provides a large setting force to push through debris-laden environment to set the slips 22 of the liner hanger 20. In one example, an applied tubing pressure from the surface of 2600-psi against the seated plug B in the actuator seat 82 relates to an applied setting pressure of about 10,000-psi to the hydraulic setting piston 25 of the liner hanger 20.

Figure 4A:
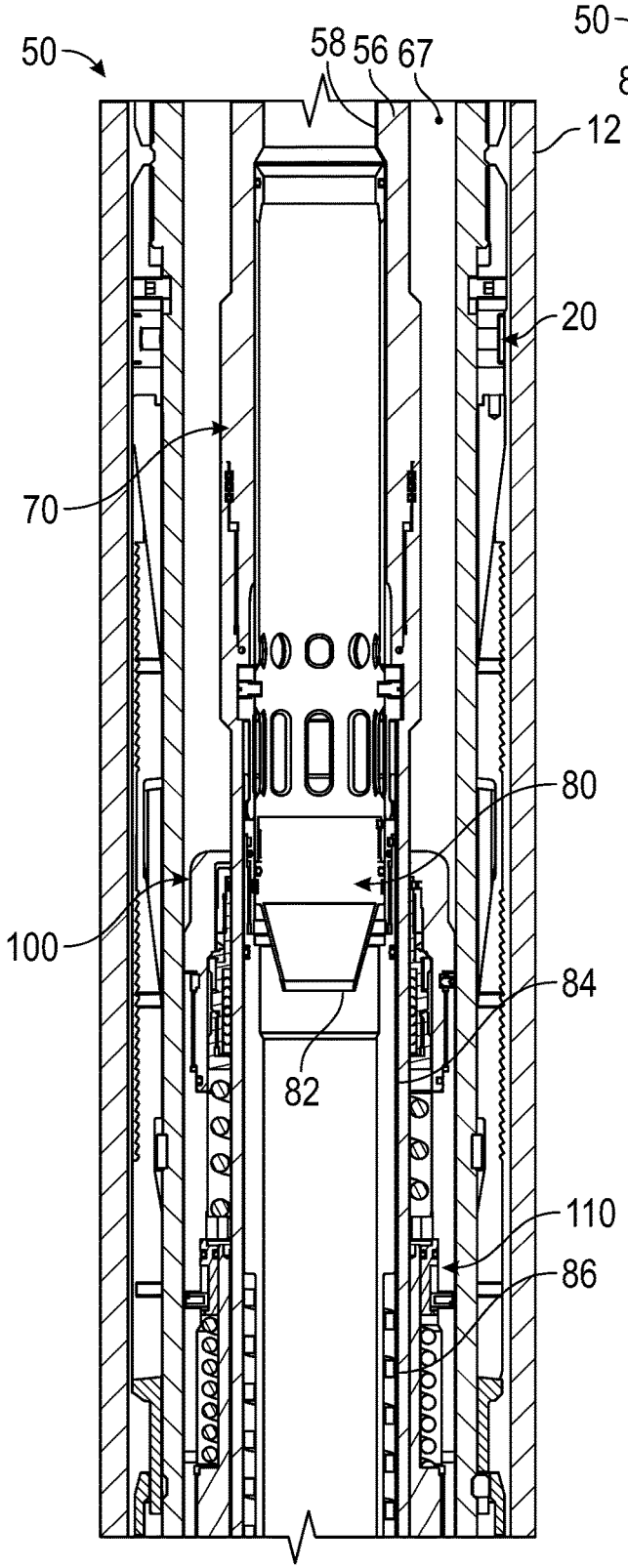
FIGS. 4A-4B illustrate cross-sectional views of detailed portions of the disclosed setting tool according to another embodiment.
Figure 4B:
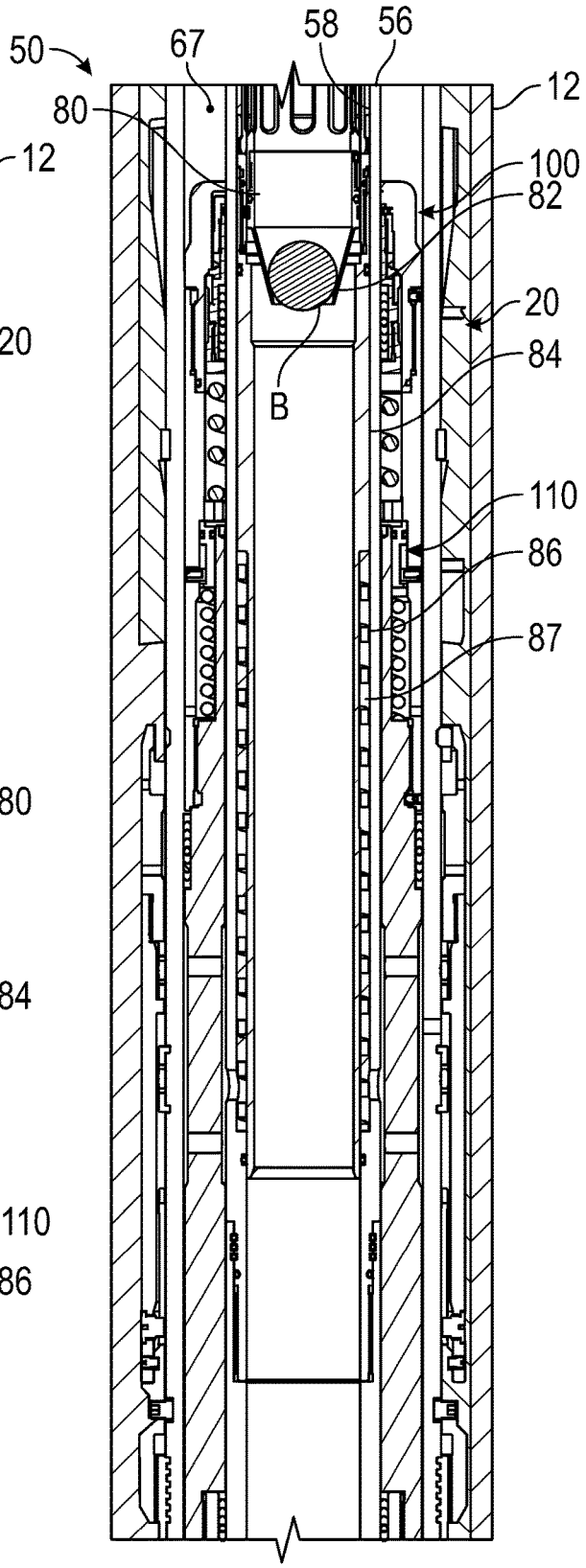

FIGS. 4A-4B illustrate cross-sectional views of detailed portions of the disclosed setting tool 50. These views are similar to those disclosed above with reference to FIGS. 3A-3B. In this embodiment, the actuator 80 is shown with the locking mechanism 70. Shown without a ball engaged in FIG. 4A, the seat 82 is held uphole by the locking mechanism 70. Shown with the ball engaged in FIG. 4B, the seat 82 is shifted downhole when the locking mechanism 70 is released. In contrast to the configuration in FIGS. 3A-3B, the piston 84 of the actuator 80 disposed in the bore 58 of the tool body 56 is not arranged to engage an uphole shear pin (88*a*; FIGS. 3A-3B) for a secondary pressure relief system of the tool volume 87 discussed in more detail below.

Figure 5:
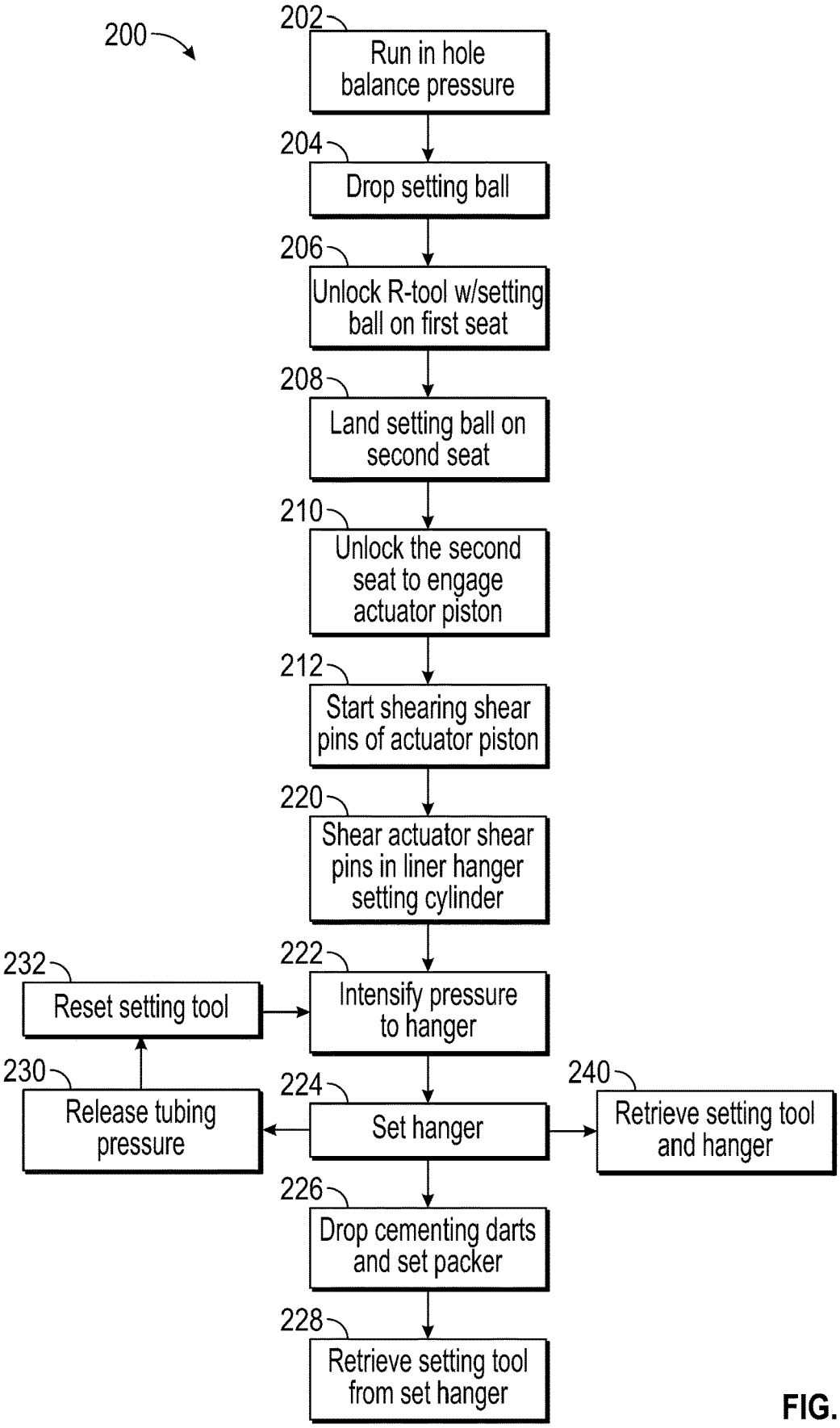
FIG. 5 illustrates a process of running and setting a liner hanger system according to the present disclosure.

FIG. 5 illustrates a process 200 for running in and setting the liner hanger 20 with the setting tool 50 of the present disclosure. Initially, the setting tool 50 is arranged (sealed and locked) in the liner hanger 20, the bonnet 60 has its volume filled with clean actuation fluid, etc. The liner hanger 20 is then run into position in the borehole using the setting tool 50 disposed on tubing. During run in, pressure in the setting tool's volume 87 is balanced to hydrostatic pressure in the borehole by drawing the actuation fluid from the reserve volume 67 of the bonnet 60 to the tool volume 87 of the tool 50 (Block 202).

Once the setting tool 50 runs in the liner hanger 20 to depth, a setting ball B is dropped to the release mechanism 53 of the setting tool 50 (Block 204). The setting tool 50 is then unlocked using tubing pressure against the dropped ball B seated in a first seat of the release mechanism 53 (Block 206). FIGS. 6A-6B and 7A-7C discussed below show details of this first stage of operation.

Figure 8A:
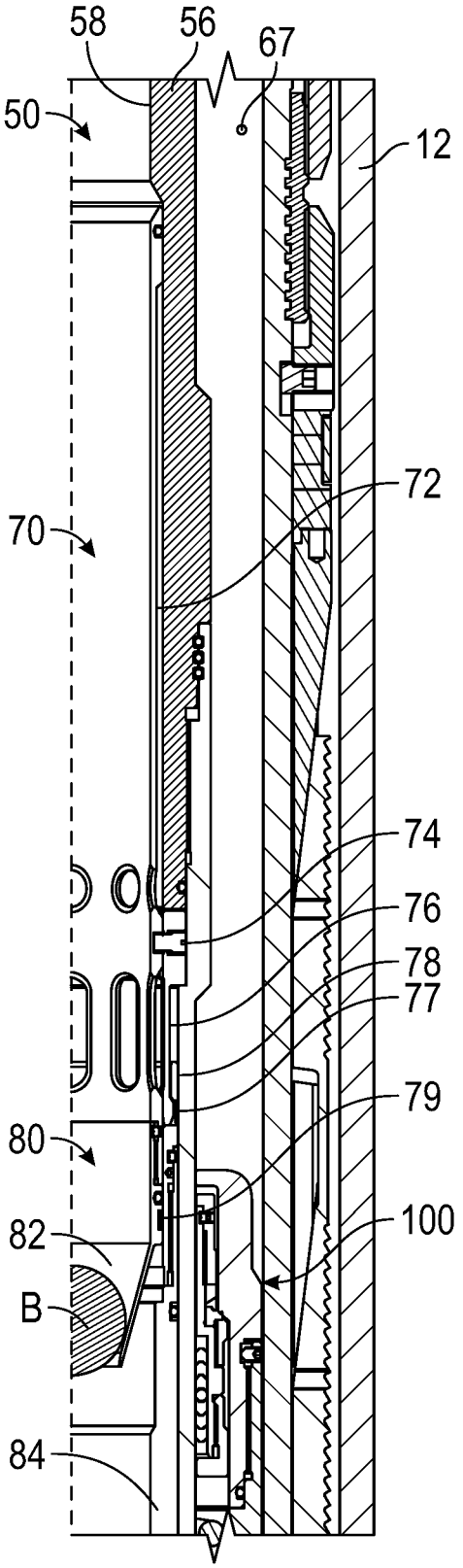
FIGS. 8A-8B illustrate detailed cross-sectional views of a second activation seat in the disclosed setting tool.
Figure 8B:
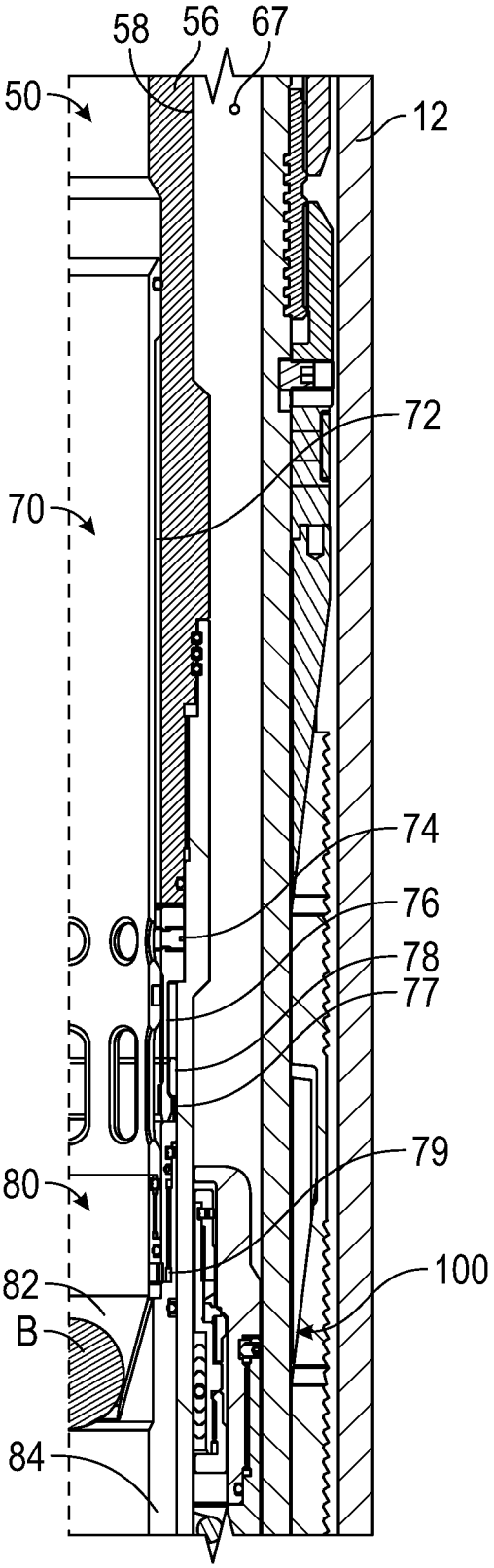

With the ball B expelled from the release mechanism 53, the ball B reaches a second seat 82 of the actuator 80 (Block 208), and pressure is applied to unlock a locking mechanism 70 holding the seat 82 (Block 210). FIG. 8A-8B shows details of this second stage of operation. Once the seat 82 is unlocked, tubing pressure against the ball B seated in the actuator seat 82 can start to shear the floating actuator piston 84 of the actuator 80 free (Block 212).

Figure 9A:
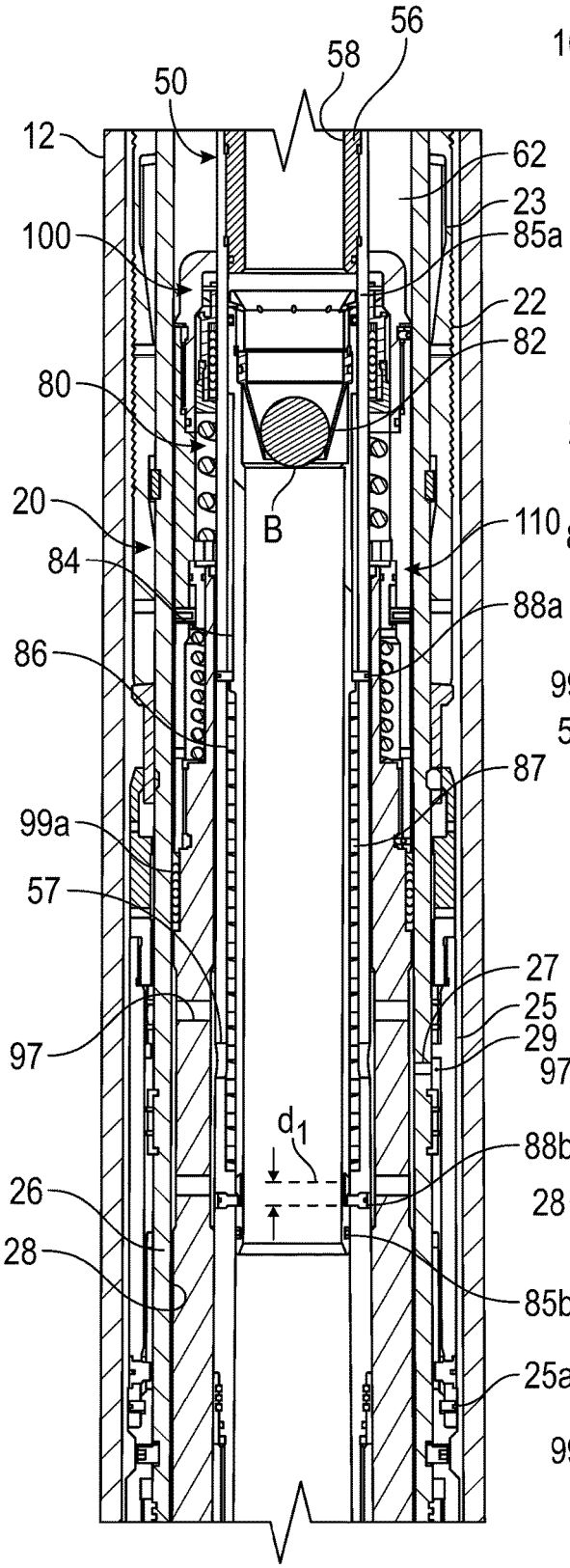
FIGS. 9A-9C illustrate cross-sectionals views of the setting tool and the liner hanger system in stages of setting.
Figure 9B:
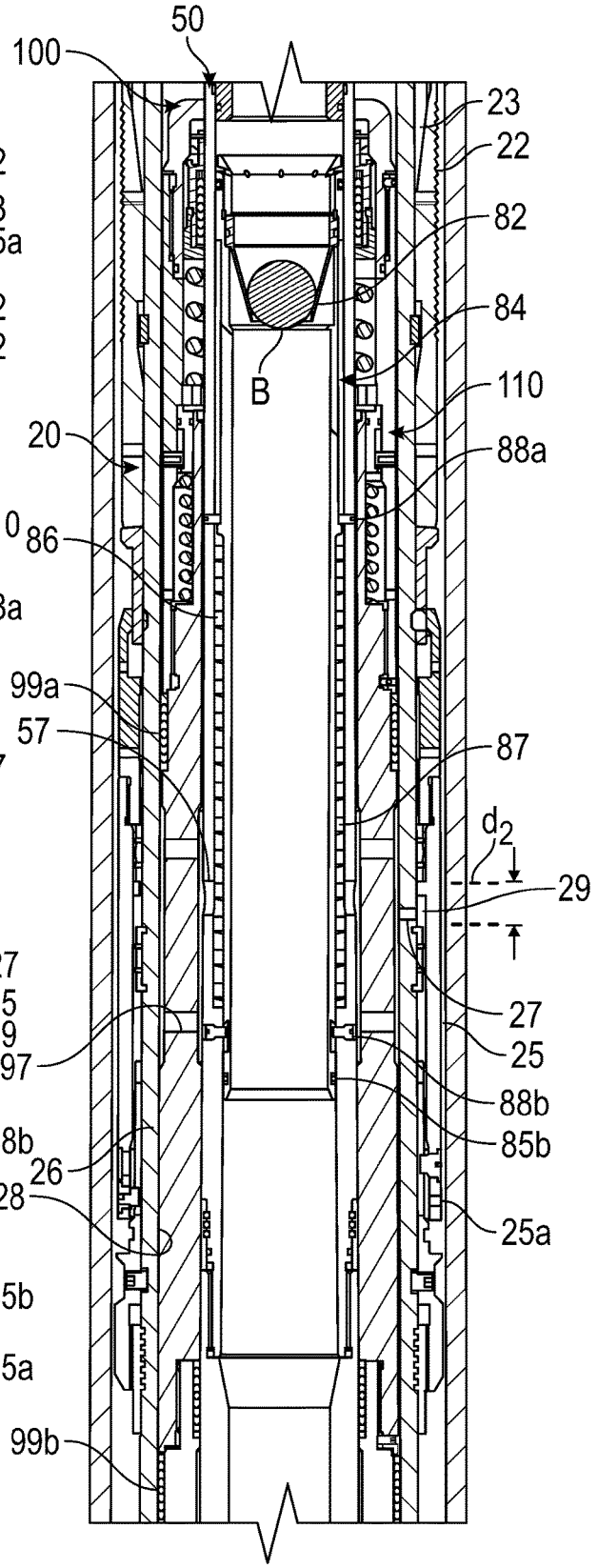
Figure 9C:
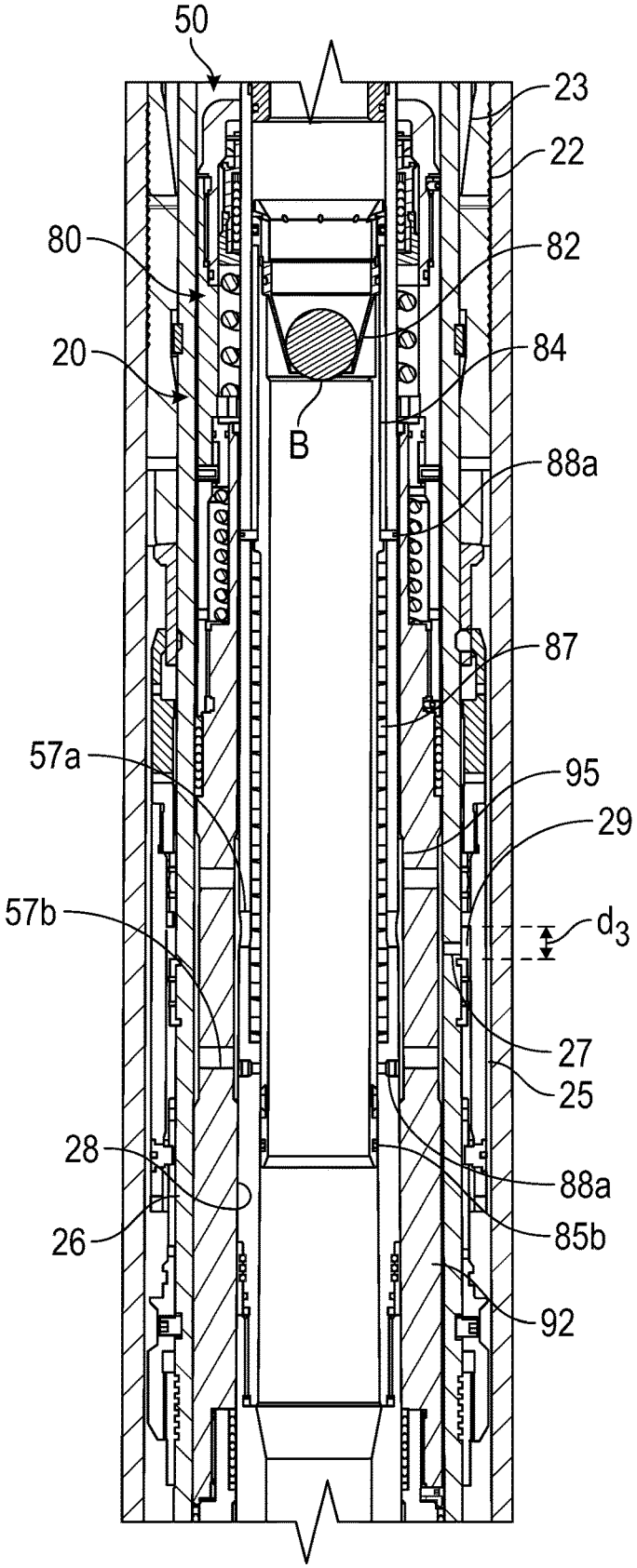

Operation of the setting tool 50 can then follow a normal stage of operation (Blocks 220). FIGS. 9A-9C show details of this stage of operation. Tubing pressure is increased behind the engaged plug B in the actuator seat 82, and the actuator piston 84 is moved in the setting tool 50 in response to the applied tubing pressure behind the engaged plug B. The actuator piston 84 shears free (Block 220). Movement of the actuator piston 84 intensifies the applied tubing pressure to an intensified pressure of the actuation fluid in the tool volume 87, and this intensified pressure is communicated to the hydraulic setting piston 25 of the liner hanger 20 (Block 222).

When successful, the liner hanger 20 is set in the casing 12 by actuating the hydraulic setting piston 25 of the liner hanger 20 using the intensified pressure (Block 224). When setting of the liner hanger 20 is successful in the end, then further stages of operation can follow in which cementing darts are dropped and a packer of the liner hanger system is set (Block 226). Once operations complete, a releasable connection 94 on the setting tool 50 is released from inside the liner hanger 20, and the setting tool 50 is retrieved from the liner hanger 20 set in the casing 12 (Block 228).

Figure 12:
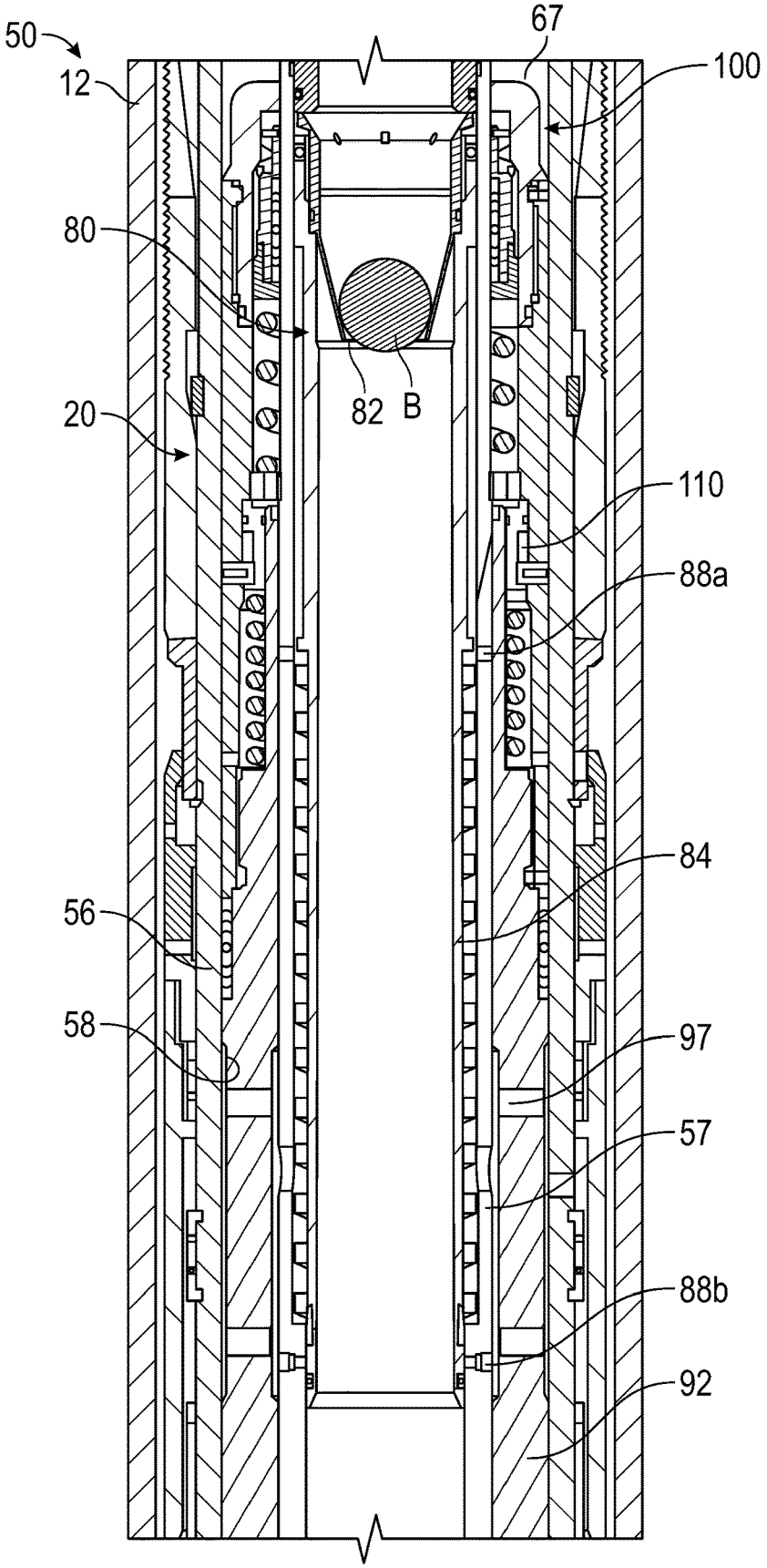
FIG. 12 illustrates a cross-sectional view of an actuator piston of the setting tool breached to an uppermost position.
Figure 13:
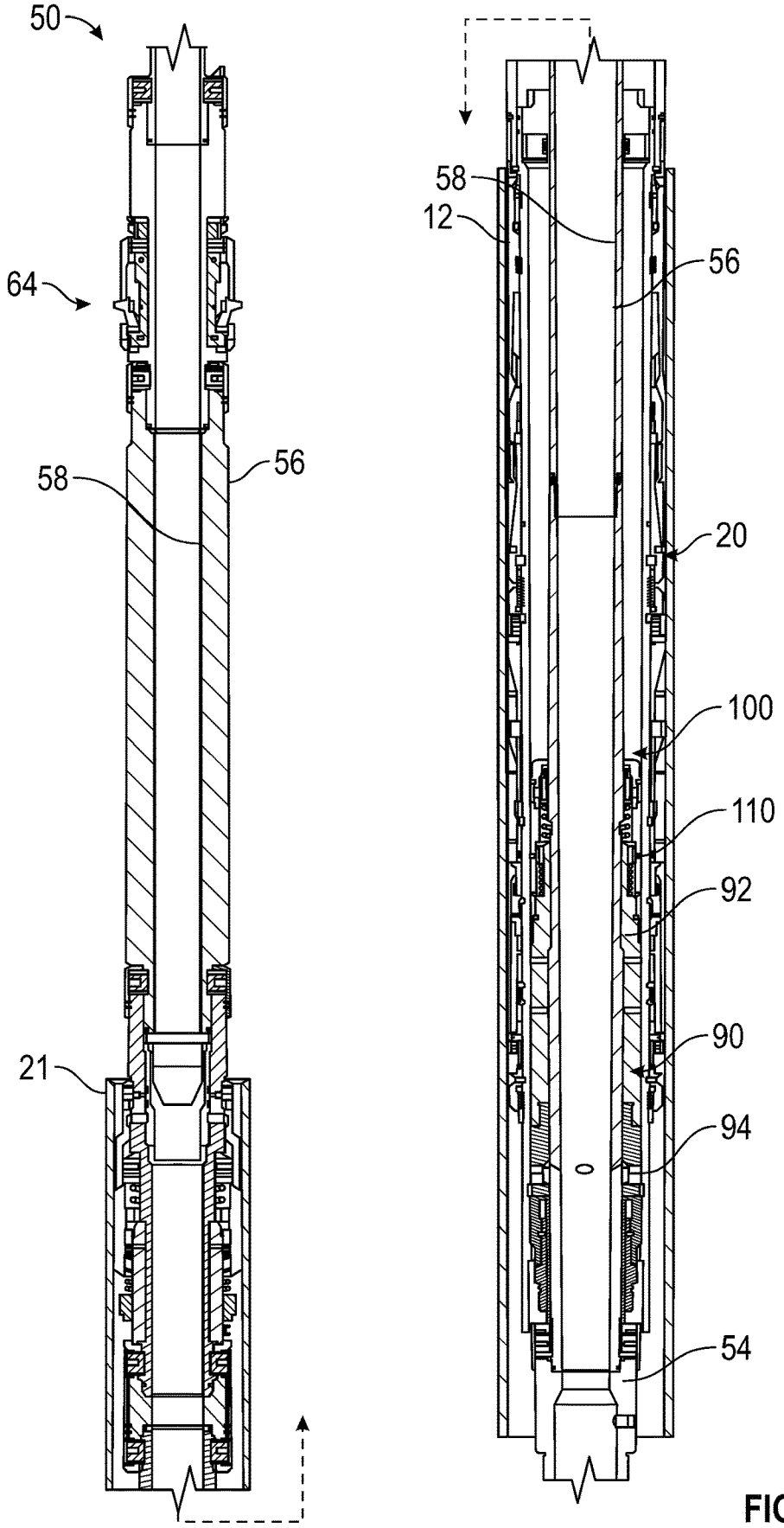
FIG. 13 illustrates cross-sectional views of the setting tool and the liner hanger system during a retrieval stage.

Should normal operation be unsuccessful, operation of the setting tool 50 can then follow an alternative stage of operation in which the setting tool is reset and actuation is reattempted (Blocks 230, 232). Again, FIGS. 9A-9C show details related to this alternative stage. If setting operations fail, operation of the setting tool 50 can follow a retrieval plan to remove the tool 50 and liner hanger 20 (Block 240). FIGS. 12-13 show some details of retrieval stages.

Figure 6A:
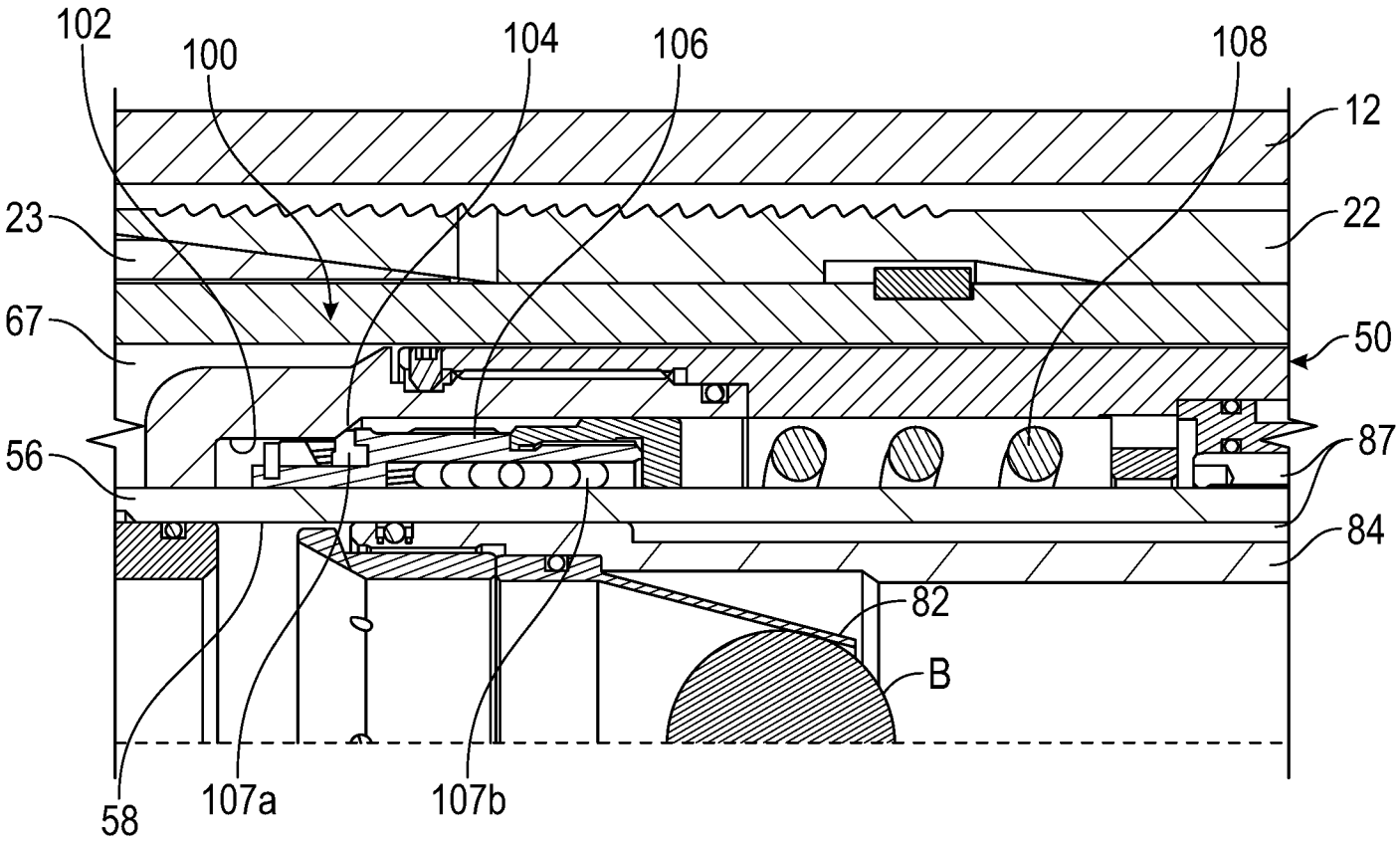
FIG. 6A illustrates a detailed view of a balancing check valve assembly for the disclosed setting tool.

FIGS. 6A-6B and 7A-7C illustrate cross-sectionals views showing portions of the setting tool 50 and the liner hanger 20 in a first stages of setting. In these first stages, the liner hanger 20 is run to depth in the casing 12. As shown in FIG. 6A, the balancing check valve assembly 100 is a check valve that allows for pressure to balance between the clean reserve volume 62 of the junk bonnet 60 and the clean tool volume 87 for the activation piston 84 on the setting tool 50. Hydrostatic pressure builds as the setting tool 50 is run downhole, and the balancing check valve 100 allows fluid at the increasing pressure of the bonnet's volume 67 to enter into the tool's volume 87 for the activation piston 84. This ensures that there is a balance of pressure once the activation piston 84 is ready to be moved.

As shown in FIG. 6A, the balancing check valve 100 has a piston chamber 102 and a piston 106. The piston chamber 102, in the form of a cylindrical chamber, is disposed in communication between the reserve and tool volumes 67, 87 and has a chamber seat 104 disposed therein. The piston 106 is in the form of a cylindrical body disposed in the piston chamber 102. The piston 106 is movable in the piston chamber 102 relative to the chamber seat 104 in response to a pressure differential. As shown, the movable piston 106 has an outer annular seal 107*a* that can selectively engage and seal with the chamber seat 104. An inner annular seal 107*b* on the piston 106 stays sealed to the tool body 56 and can include chevron seals as shown.

The piston 106 in a closed position as shown in FIG. 6A has the seal 107*a* engaged with the chamber seat 104, which prevents fluid communication in the reverse direction from the tool volume 87 to the reserve volume 67. The piston 106 in an opened condition is disengaged from the chamber seat 104, which permits fluid communication from the reserve volume 67 to the tool volume 87. A biasing element 108 disposed in the piston chamber 102 biases the piston 106 toward the chamber seat 104 and acts against the pressure difference.

Figure 6B:
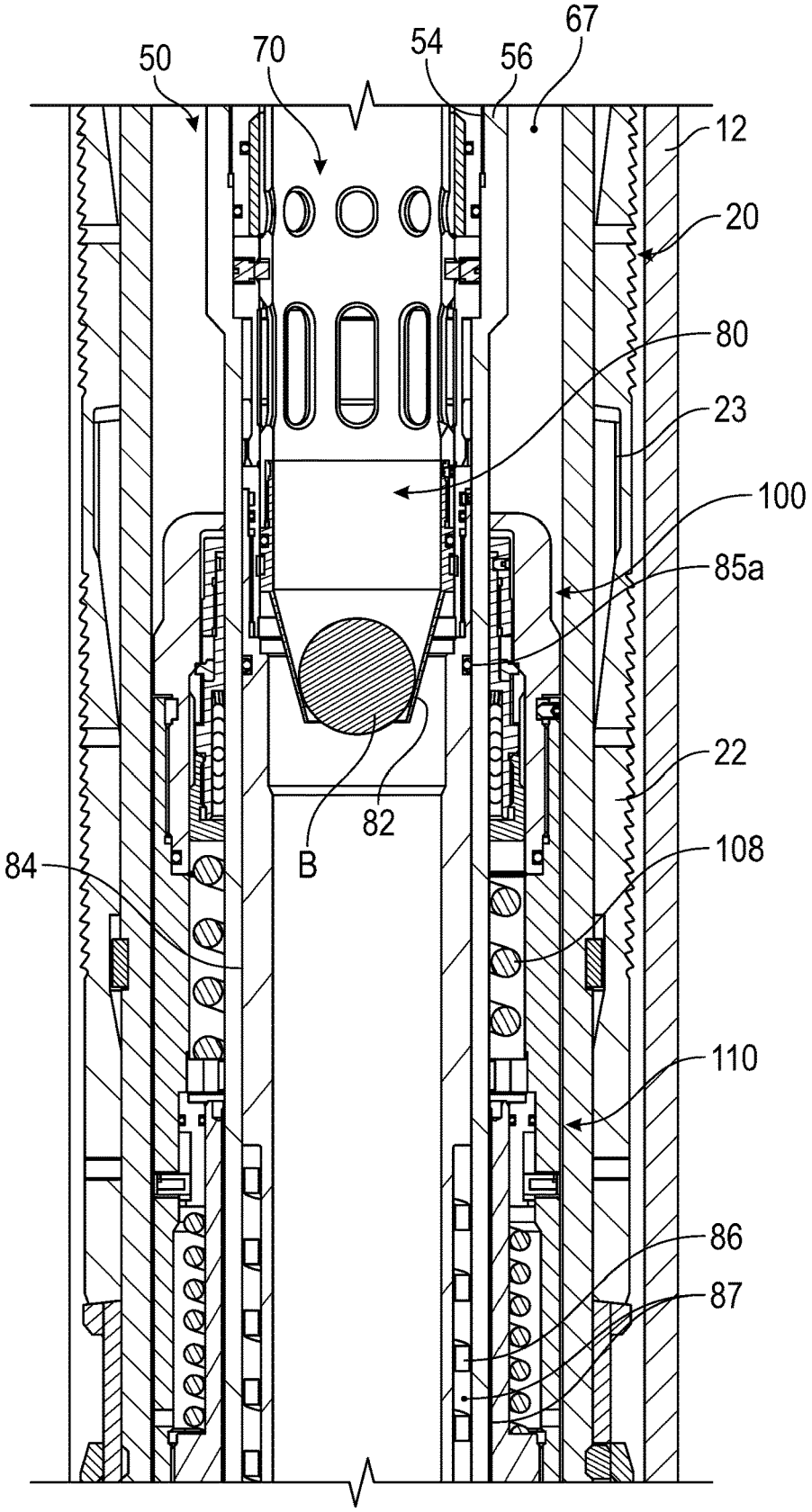
FIG. 6B illustrates a detailed view of a balancing check valve assembly for the disclosed setting tool according to another embodiment.
Figure 7A:
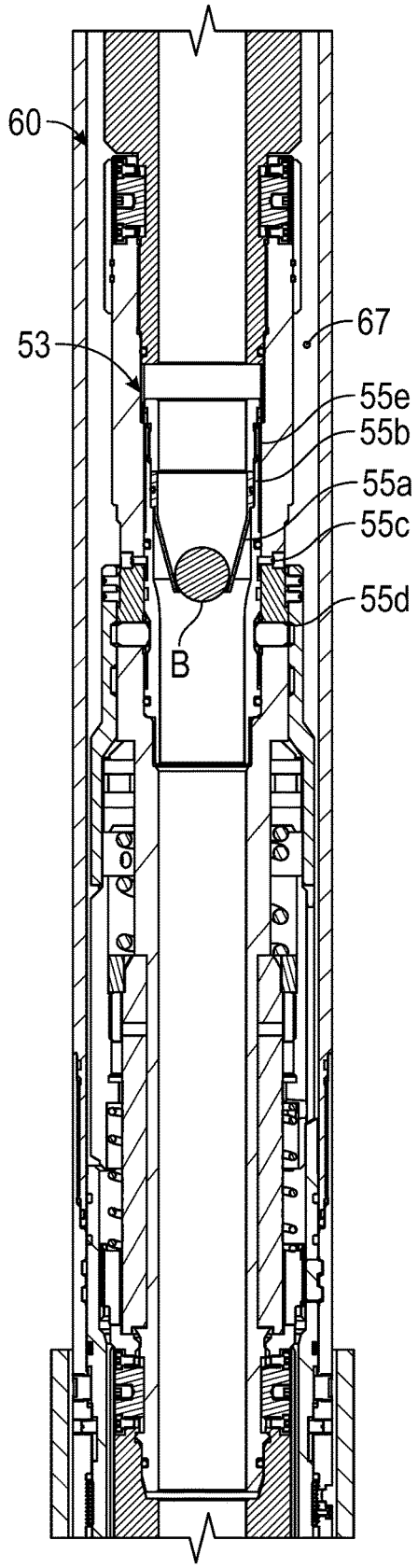
FIGS. 7A-7C illustrate detailed cross-sectional views of a first release seat in the disclosed setting tool
Figure 7B:
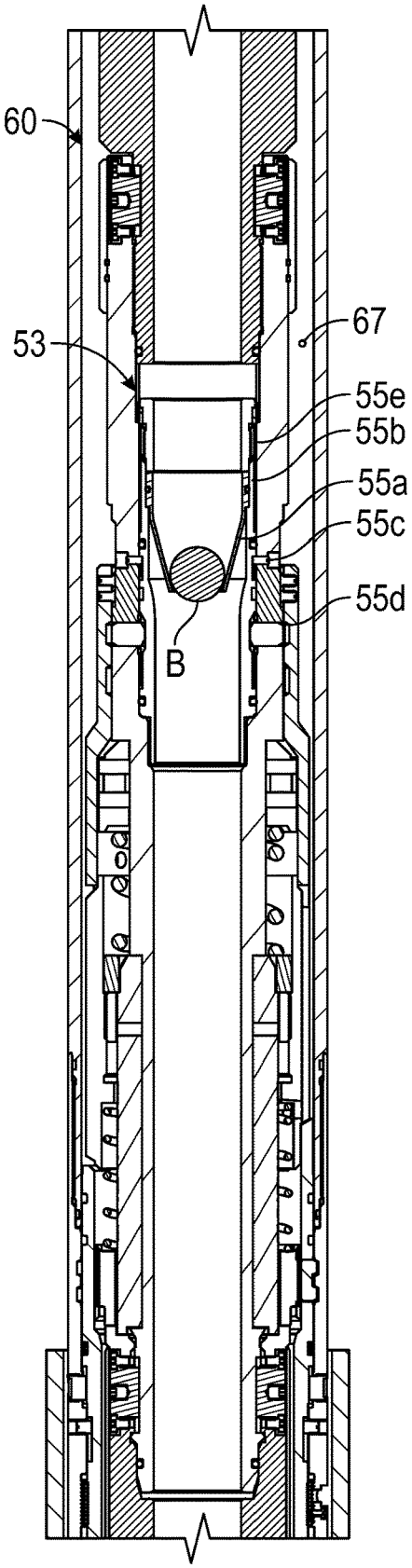
Figure 7C:
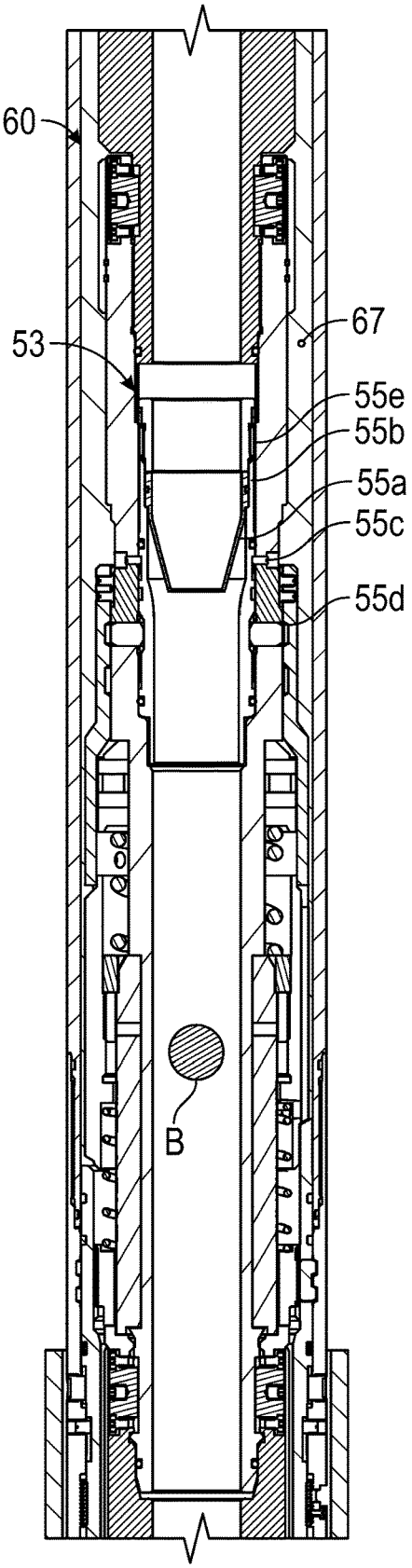

FIG. 6B illustrates another detailed view of the balancing check valve assembly 100 for the disclosed setting tool 50. This view is similar to that disclosed above with reference to FIG. 6A. In this embodiment, the actuator 80 is shown with the locking mechanism 70. Shown with the ball B engaged, the seat 82 is shifted downhole when the locking mechanism 70 is released. In contrast to the configuration in FIG. 6A, the piston 84 of the actuator 80 disposed in the bore 58 of the tool body 56 is not arranged to engage an uphole shear pin (88*a*; FIGS. 3A-3B) in an uphole direction for the secondary pressure relief system of the tool volume 87 discussed in more detail below As then shown in FIGS. 7A-7C, the setting tool 50 is then unlocked once run to depth. To do this, a ball B is landed on the setting tool's release seat 55*a* of the release mechanism 53. Tubing pressure is increased to a predetermined pressure (e.g., 500 psi) to shift a sleeve 55*c*, which unprops locking dogs 55*d* in the release mechanism 53. Once shifted, the sleeve 55*b* is locked down, with a catch ring 55*e*, to prevent re-propping of the dogs 55*d*. With the release mechanism 53 unlocked, the setting tool's body 56 can be manipulated relative to other components of the system. Eventually with the applied pressure to a predetermined threshold, the ball B is expelled from expandable release seat 55*a* to travel toward the tool's second seat (82) for setting the liner hanger (20).

Continuing with the setting procedures, FIGS. 8A-8B shows details of the second stage of operation. As shown in FIG. 8A, the ball B lands on the second expandable seat 82 of the slick stinger actuator 80. The seat 82 has pressure acting on both sides so the arrangement is pressure balanced and the shear pins 74 do not have a load on them until the ball B engages in the seat 82. Pressure applied against the landed ball B shears the actuator seat 82 free of the locking mechanism 70 so that the actuator 80 can be operated. As noted previously, the locking mechanism 70 prevents premature actuation of the actuator 80, which could be caused by any number of reasons during run-in. For example, the velocity of the fluid flow through the seat 82 could prematurely activate the actuator 80 if not locked in place.

The locking mechanism 70 includes a sleeve 72 having the actuator seat 82. The sleeve 72 is held by shear pins 74 inside the tool body 56, and a locking collet 76 has collet fingers 77 held engaged against a ring 78 inside the tool body 56. As will be appreciated, other configurations can be used to lock the seat 82 in place.

While running in the hole with the liner hanger 20/setting tool 50, the actuator seat 82 is locked into place by the locking mechanism 70 having the supported locking collet 76. The shear pins 74 prevent premature movement of the sleeve 72 in response to forces during run-in, such as any forces caused by fluid flow through the tool body 56. Once ready to deploy the liner hanger 20 in the casing 12, the actuator piston 84 may only be actuated after a closed pressure volume is pressurized to produce the required force to shear locking pins 74 and un-support the locking collet 76 so the seat 82 can engage (affix to) the piston 84.

To do this, initial pressure is applied behind the dropped setting ball B landed on the expandable seat 82, the sleeve 72 can shear the shear pin 74 once a predetermined force is reached. The sleeve 72 then shifts a short distance. The shifted sleeve 72 then shoulders against the actuator's piston 84 so that pressure applied against the seated ball B in the seat 82 can be applied to the actuator's piston 84. A lock ring 79, such as an expanding locking C-ring 79 on the sleeve 72, can lock in a locking groove of the piston 84 to lock them together. This locking prevents re-supporting the collet 76 and locking the sleeve 72 again.

As shown in FIG. 8B, the back support on the collet fingers 77 is removed. The unsupported collet fingers 77 can allow shifting of the actuator piston 84 uphole (to the left in FIG. 8B) should the upper shear pin 88*a* be sheared according to procedures disclosed below.

As shown in FIGS. 9A-9C, the actuator piston 84 includes a temporary connection 88*b* with the tool bore 58. The temporary connection 88*b* has a connected state configured to prevent movement of the actuator piston 84. In response to a predetermined force, the temporary connection 88*b* has an unconnected state, which allow movement of the actuator piston 84 in response to the applied tubing pressure behind the deployed plug B engaged in the actuator seat 82. As shown here, the temporary connection 88*a* can include shear pins disposed between the actuator piston 84 and the tool bore 58.

During operation as shown in FIGS. 9A-9C, the setting tool 50 is activated to start shearing the hydraulic setting piston 25 of the liner hanger 20 free. Here, tubing pressure is increased behind the seated plug B to a predetermined pressure (e.g., 130-220 psi) to start shearing the actuator piston 84 free. The actuator piston 84 may travel a short distance (d1) before being freed.

As shown in FIG. 9B, increased pressure can start to shear the hydraulic setting piston 25 free by shearing the shear pins 25*a*, and the setting piston 25 can move an initial distance (d2). As the actuator piston 84 moves, the distance of the upper shear pins 88*a* from a shoulder of the piston 84 increases. As noted previously, the setting volume 87 of the actuator 80 holds the clean actuation fluid communicated from the clean volume 67 by the balancing check valve 100. This volume 87 is sealed from tubing fluids by the piston's seals 85*a-b* that engage inside the bore 58 of the setting tool's body 56. Movement of the actuator piston 84 decreases this volume 87 and builds pressure that is communicated to the hanger's hydraulic setting piston 25.

As then shown in FIG. 9C, tubing pressure is increased to an increased pressure (e.g., 1300-psi) to shear the shear pins 88*b* of the actuator piston 84 and begin the transfer of fluid from the setting volume 87 to the hydraulic cylinder setting chamber 29 of the hanger's piston 25 to set the slips 22. Fluid in the setting volume 87 communicates through ports 57, 97 in the setting tool 50 and pack-off body 92 to reach a sealed annulus 95 between the pack-off body 92 and the inner bore 28 of the liner hanger's body 26. Packing seals 99*a-b* and 107*b-c* on the setting tools 50 are sealed against the inner bore 28 so that the annulus 95 is clear of other fluids. The clean fluid can travel through the setting port 27 of the hanger 20 to the chamber 29 for the hanger's piston 25.

Once the shear pins 88*b* are sheared, the volume 87 of the tool's volume 87 can be transferred to the liner hanger hydraulic chamber 29. The tubing pressure is increased to a predetermined pressure until the liner hanger 20 takes liner hang weight. Preferably, the tubing pressure is increased in increments to the predetermined pressure. For example, the tubing pressure can be increased in 200-psi increments from 1300-psi to reach 2100-psi.

As the actuator piston 82 travels a greater distance as shown in FIG. 9C, the hydraulic setting piston 25 moves a greater distance (d3) so that the slips 22 rid up the cones 23 and contact with the casing 12. At the final tubing pressure (e.g., 2100-psi), the pressure from the actuator piston 84 to the hydraulic setting chamber 29 is intensified to a greater pressure (e.g., 7700 psi). During the time that the intensifier pressure increases, the pressure moves the hydraulic setting piston 25 to push the slips 22 onto the ramps of the cones 23.

As can be seen, the actuator piston 84 transfers the clean fluid to the piston chamber 29. The axial displacement of the closed ball seat 82 is equal to the axial displacement of the actuator piston 84. The displaced volume created by the differential piston volume of the actuator piston 84 can sufficiently displace the hydraulic setting piston 25 to create slip contact with the casing 12. The intensifying actuator piston 84 also compresses the fluid volume to create an elevated internal pressure (e.g., 10,000 psi). The working fluid may preferably be water because the Bulk Modulus of water can help calculate the required amount of water needed to pressurize the hydraulic setting piston 25 to deliver the pressure load to set the slips 22.

Once the liner hanger 20 is determined to be able to take weight, the applied surface pressure is increased to the point where the setting ball B is expelled from the expandable seat 82 and the controlled closed volume is removed. The applied pressure from the surface drives the actuator piston 84 to apply pressure to the hydraulic chamber 29 of the hydraulic setting piston 25 as long as the setting ball B remains on the expandable seat 82 and the actuator piston 84 displaces to its fully stroked position.

As can be seen, the setting of the liner hanger 20 depends on applied pressure from the surface to a closed tubing volume created by the setting ball B on the expandable seat 82. The setting ball B eventually expands the actuator seat 82 and is expelled at a predetermined pressure, such as 2600-psi depending on the implementation.

As mentioned, debris-laden environment may increase the need for more force to move components to set the liner hanger 20. For this reason, the actuator piston 84 provides a differential piston that takes the applied surface pressure and intensifies the output pressure at a configured ratio, such as 3.6:1, to the hydraulic setting chamber 29 of the liner hanger 20. As one example, input surface pressure of 2600-psi can deliver an output pressure of 9550-psi to the liner hanger system to force its way through bedded debris.

The total stroke of the actuator piston 84 accounts for the pressure to rupture the shear pins in the liner hanger's piston 25, fully stroke the piston 25, and drive the slips 22 into the wall of the casing 12 with the application of surface pressure with volume to spare. If another application of setting pressure is desired to be applied to the hydraulic setting piston 25 of the liner hanger 20, operators can release the applied surface pressure, as this will allow the actuator piston 84 of the intensifier to return to its start position. The hydraulic setting piston 25 cannot go back to its original position due to a body lock ring or slip lock dogs. Yet, as the actuator piston 84 is pushed back by its compression spring 86, a differential pressure is created that causes the balancing check valve 100 of the pack-off assembly 90 to accept clean fluid from the bonnet's volume 67. This recharges the setting volume 87 with fluid for the next pressure application. At this point, the surface pressure may again be applied.

The slips 22 should be able to handle the liner hanger's weight. If the slips 22 are taking load, then pressuring-up of the tubing pressure can be performed until the ball B is expelled from the expandable set 82. The expelling pressure can be a pressure of about 2300-2500-psi with a maximum of 9200-psi intensified pressure to the hydraulic setting piston 25. This pressure can be a safe burst load to the liner hanger 20.

The expelling of the setting ball B through the expandable seat 82 in the debris environment may require applying surface pressures greater than the predetermined pressure (e.g., 2600 psi) to the point where the intensified pressure of the actuator piston 84 delivers a pressure greater than a maximum pressure (e.g., 10,000-psi) that can potentially damage equipment.

Figure 10A:
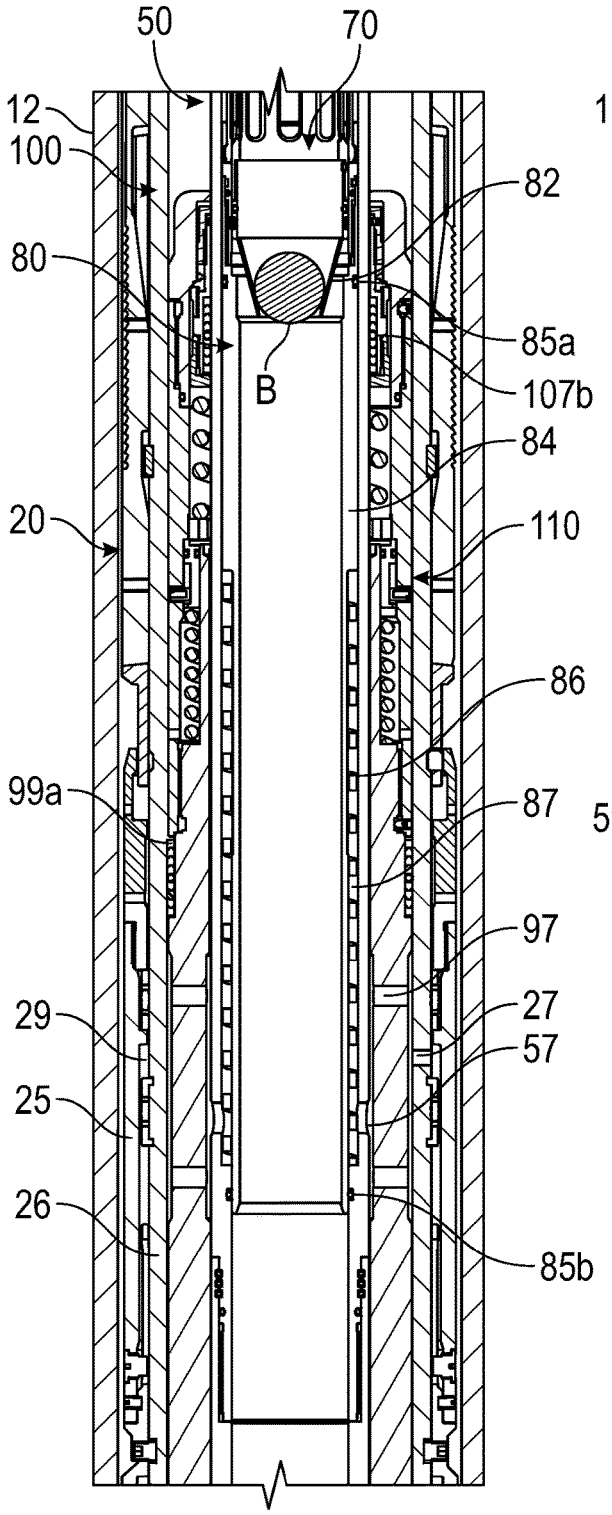
FIGS. 10A-10B illustrate cross-sectionals views of another embodiment of the setting tool and the liner hanger system in stages of setting.
Figure 10B:
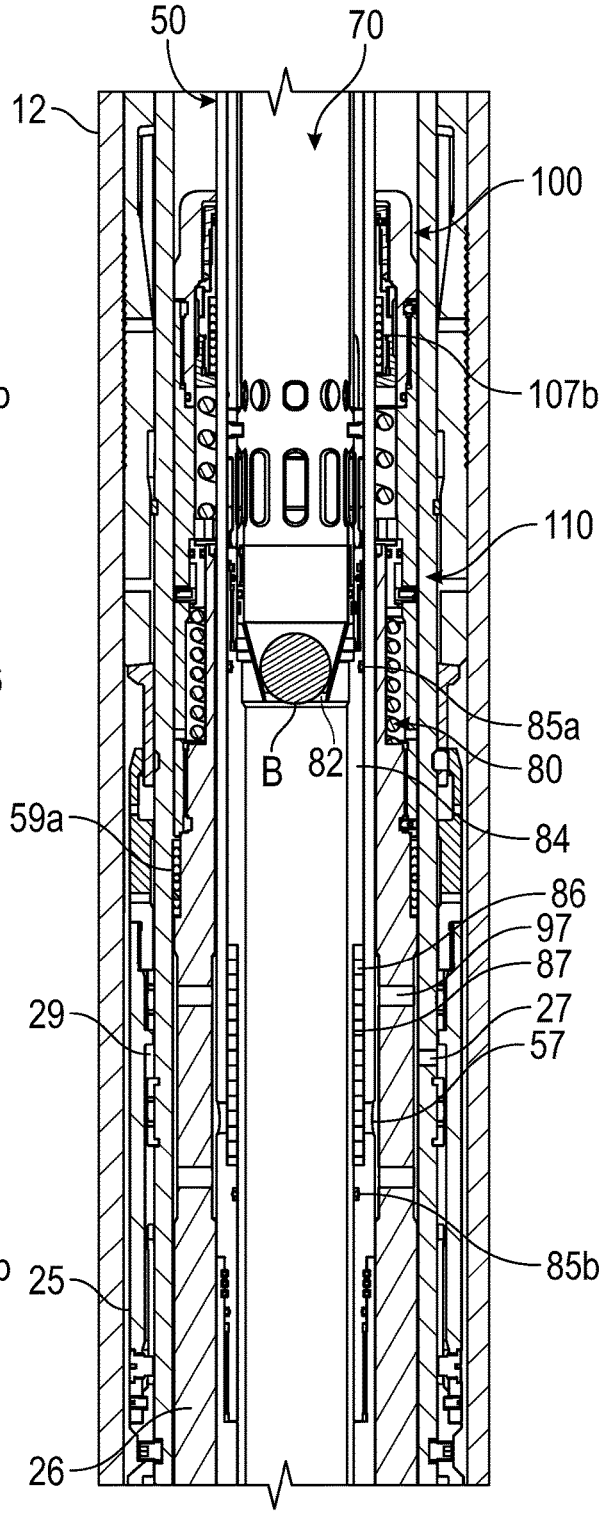

FIGS. 10A-10B illustrate cross-sectionals views of another embodiment of the setting tool 10 and the liner hanger system in stages of setting. These views are similar to those disclosed above with reference to FIGS. 9A-9C. In this embodiment, the actuator 80 is shown with the locking mechanism 70. Shown with the ball B engaged in FIG. 10A, the seat 82 is shifted downhole when the locking mechanism 70 is released, and pressure applied behind the seated ball B shifts the actuator piston 84, reducing the tool volume 87. In contrast to the configuration in FIGS. 9A-9C, the piston 84 of the actuator 80 disposed in the bore 58 of the tool body 56 is not arranged to engage a shear pin (88*a*; FIGS. 3A-3B) in an uphole direction for the secondary pressure relief system of the tool volume 87 discussed in more detail below.

Figure 11A:
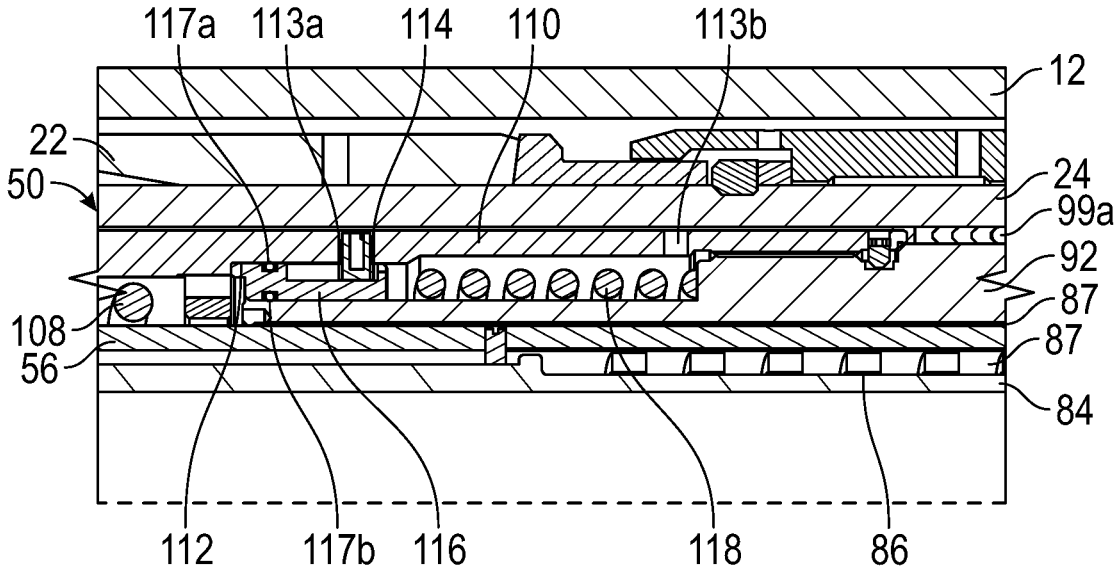
FIGS. 11A-11B illustrate cross-sectional views of an over-pressure venting assembly on the disclosed setting tool.
Figure 11B:
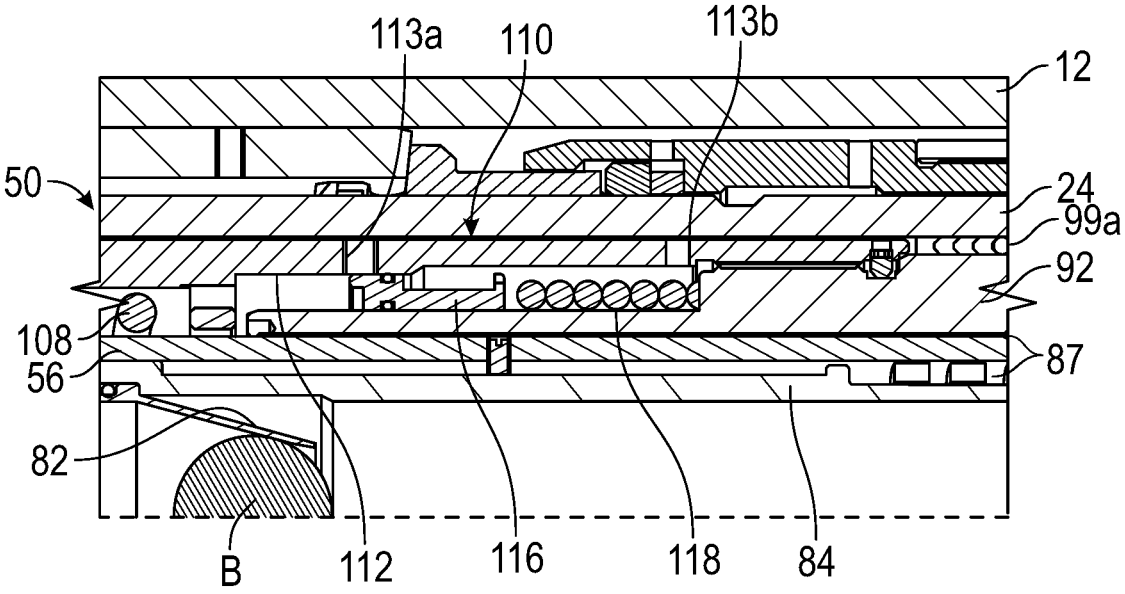

The over-pressure venting assembly (i.e., venting valve 110) can respond to the increase in the intensified pressure and can shift, but not shear a venting pin 114. To prevent over-pressurization of the hydraulic setting piston 25 and its seals, for example, the venting valve 110 prevents any pressure above the maximum pressure (10,000 psi) from being delivered to the liner hanger 20. As shown in FIGS. 11A-11B and described in more detail below, the venting valve 110 has a floating internal piston 116 and expands the tool volume 87 in reaction to the intensified pressure. For example, the gap between the floating piston 116 and the venting shear pins 114 can relieve hydrostatic pressure if the running tool 50 and the liner hanger assembly needs to be retrieved without setting. This relief of the hydrostatic pressure can prevent the slips 22 on the liner hanger from setting during retrieval.

In maintaining the pressure balance, the venting valve 110 can also respond to increases in temperature downhole by moving accordingly. For example, the gap between the floating piston 116 and the venting shear pins 114 can be calibrated for thermal expansion of the clean fluid in the volume 87 from ambient temperature up to about 350 F. This can help keep pressures balanced during run-in of the setting tool 50 and when operated at depth.

Once the maximum pressure (10,000 psi) threshold has been created, the floating piston 116 can shear a set of venting shear pins 114 to relieve the pressure to outside of the isolated volume 87 to the reserve volume 67, where the floating junk bonnet 60 can react to the pressure increase through expanding volume upwards. At this point, the system equalizes and returns to its original position due to the compression spring 118.

Once the setting ball B has been expelled, the system reverts to where the over-pressure venting valve 110 closes, the actuator piston 84 is pushed back into place by the compression spring 86, the hydraulic setting piston 25 returns to an intermediate position determined by the location of the slip lock dogs, and any fluid draw into the volume 87 from the spring 86 pushing the actuator piston 84 comes from the balancing check valve 100.

In a debris environment, the expelling pressure of the ball B from the seat 82 can be as much as 2800 psi resulting in 10.3 ksi in intensified pressure to the hydraulic setting piston 25 of the liner hanger 20. This event would activate the over-pressure venting valve 110 to protect the liner hanger from over pressuring. Further details are disclosed below with reference to FIGS. 11A-11B.

In final stages of operation, cementation darts (not shown) are dropped, and a packer of the liner hanger system is set as normal. The running tool 50 can then be retrieved. As shown in FIG. 13, the setting tool 50 includes a releasable connection 94 inside the hanger bore 28. The releasable connection 94 in an engaged condition has locking dogs engaged with the hanger bore 28. In the unengaged position, the releasable connection 94 has the locking dogs disengaged from the hanger bore 28, which allows the stinger portion of the setting tool 50 to be removed from the hanger's bore 28.

As shown in FIG. 13, the setting tool 50 is pulled out of the liner hanger 20, which has been set in the casing 12. The packer actuator 64 is stroked a distance from the polished bore receptacle 21. Meanwhile, at the other end, the pickup spacer 54 moves toward the setting tool's pack-off assembly 90 so that the locking dogs of the releasable connection 94 can be disengaged.

During setting operations, an alternative operation can be performed when the slips 22 fail to set due to debris when shearing the actuator piston 84. As noted previously with reference to FIGS. 9A-9C, the tubing pressure is increased to the predetermined pressure (1300-psi) to shear the shear pins 88*b* of the actuator piston 84 and to begin the transfer of fluid from the setting volume 87 to the hydraulic setting piston 25 to set the slips 22. The actuator piston 84 moves a short distance d1 to stat shearing the actuator piston pins 88*b*.

Once the actuator piston 84 shears the pins 88*b*, the fluid volume of the tool chamber 87 is transferred to the hanger's hydraulic chamber 29. Again, the transfer of input pressure to output pressure can be controlled by controlling the application of the tubing pressure, such as in stepped increments. The tubing pressure is increased to the predetermined pressure (2100 psi), such as in 200 psi increments from 1300 psi, until the liner hanger 20 takes hang weight. The hydraulic setting piston 25 travels a distance d3 to achieve slip contact with the casing 12.

At the increase (2100 psi) tubing pressure, the intensifier pressure provided to the hydraulic setting piston 25 is intensified (e.g., to 7700 psi). The slips 22 should be able to handle the hang weight. The reasons for the slips 22 not taking a load may be because debris is preventing the hydraulic setting piston 25 from moving. If the slips 22 are not taking load and are not setting, then the tubing pressure may be relieved back to zero in this alternative operation. In relieving the pressure, the ball B is not expelled from the expandable seat 82. The actuator piston 84 is reset by the compression spring 86 to refill the tool volume 87 with charging fluid from the balancing check valve 100.

The refilling of the actuator piston's charging volume 87 allows for the full charging of the hydraulic chamber 29 of the liner hanger 20 to maximize the pressure delivered to setting the slips 22. Once the actuator piston 84 returns to its initial position, tubing pressure may again be applied to the increased pressure (e.g., 2100 to 2200-psi in 200-psi increments). The travel of the actuator piston 84 will be much less than the initial movement where fluid transfer must occur to shift the hydraulic setting piston 25. During the second pressure up to the increased tubing pressure 2100-2200-psi, the intensified pressure delivered to the hydraulic setting piston 25 will immediately hit an elevated pressure (e.g., 8100-psi). This cycling of the setting volume 87 may happen as many times as needed to drive the slips into place.

Once the expelling pressure of 2300-2500-psi with a maximum of 9200-psi intensified pressure to the hydraulic setting piston 25 is delivered, the setting ball B may be expelled from the seat 82. Again, this pressure is expected to be a safe burst load to the liner hanger 20.

Once the setting ball B has been expelled, the system reverts to where the over-pressure venting valve 110 closes, the actuator piston 84 is pushed back into place by the rectangular wire compression spring 86, the hydraulic setting piston 25 returns to an intermediate position determined by the location of the slip lock dogs, and any fluid draw from the spring 29 pushing the sleeve 84 comes from the pressure balance check valve 10. With this stage completed, operations can then follow other steps as normal.

When performing the setting stages, it is possible that too much pressure is applied by the setting tool 50 to the hydraulic setting piston 25 of the liner hanger 20. The over-pressure venting assembly 110 of the tool 50 can prevent over-pressure. As shown in FIGS. 11A-11B and described previously, the over-pressure venting assembly having the venting valve 110 is disposed on the tool body 56 and is configured to relieve the intensified pressure of the actuation fluid above a predetermined threshold in the tool volume 87 to outside the tool body 56.

The venting valve 110 includes a port 113*a* in the tool body 56 that is openable to communicate the tool volume 87 outside the tool body 56 to the reserve volume 67 contained by the bonnet 60. The port 113*a* has a shearable pin 114, and the venting valve 110 include a piston 116 disposed in fluid communication between the tool volume 87 and tubing pressure in the liner hanger (via an opening 113*b*). The piston 116 is movable to shear the shear pin 114 from the port 113*a* in response to the intensified pressure in the tool volume 87 exceeding the predetermined threshold. The piston 116 can move in a piston chamber 112 disposed in communication between the tool volume 87 and the port 113*a*. The piston 116 is movable in the piston chamber 112 relative to the shearable pin 114 in response to a pressure differential. The piston 116 in a first condition is disengaged with shearable pin 114 and prevents fluid communication from the tool volume 87 to the port 113*a*. As shown in FIG. 11B, the piston 116 in a second condition is engaged with the port's shearable pin 113*a*, and excess pressure in the tool volume 87 shears the shear pin 114, permitting fluid communication from the tool volume 87 to the port 113*a*.

As shown, the piston 116 can include a cylindrical body disposed in the piston chamber 102, and inner and outer annular seals 117*a-b* disposed on the cylindrical body of the piston 116 can seal with the piston chamber 102. A biasing element 118 disposed in the piston chamber can bias the piston 116 against the pressure in the tool volume 87 so that the piston 116 is disengaged from the char pin 114. When retrieving the setting tool 50, the piston 116 and the port 113*a* of the venting valve 110 can absorb changes in pressure. In necessary, a secondary venting system can be used in which the piston 84 can move further uphole to increase the tool volume 87. This is described below with reference to FIG. 12.

When performing the setting operations, it is also possible that the setting tool 50 needs to be retrieved without the liner hanger 20 having been set. As shown in FIG. 12, the setting tool 50 and the liner hanger 20 are shown in yet another alternative operation. The slips 22 may have failed to set because enough pressure cannot be produced by the actuator piston 84.

To pull the setting tool 50 and liner hanger 20, an internal over-pressure mechanism can relieve the internal pressure of the tool volume 87 to prevent setting the slips 22. As the system is pulled out of the borehole, the hydrostatic pressure decreases while the internal pressure of the tool volume 87 from the hydrostatic pressure at setting depth remains captured in the setting tool 50.

To relieve that trapped pressure, the actuator piston 84 includes another temporary connection (e.g., shear pins) 88*a* with the tool bore 58. The temporary connection 88*a* has a connected state configured to prevent an increase in the tool volume 87. In response to a predetermined force, however, the temporary connection 88*a* has an unconnected state so the actuator piston 84 is able to move upward and so the tool volume 87 is allowed to increase.

As shown in FIG. 12, the temporary connection 88*a* in the form of a retrieval venting shear pin 88*a* shears so the actuator piston 84 can move upward. This allow the trapped volume 87 to expand and relieves the trapped pressure, thus preventing the slips 22 from deploying while pulling the liner hanger 20 out of the hole.

In particular, the trapped pressure in the tool volume 87 acts against the shear pins 88*a* as the setting tool 50 and liner hanger 20 are retrieved. Eventually, the increased pressure shears these pins 88*a* to allow the tool volume 87 to increase. In turn, the increased tool volume 87 prevents the deployment of the slips 22 upon system retrieval by relieving the trapped hydrostatic pressure within the pack-off assembly 90 as the system is tripped back to the surface. The compensation is intended to prevent a threshold pressure (1000-psi) from being delivered to the hydraulic setting piston 25 of the liner hanger 20. As the external hydrostatic pressure is reduced when the system is brought to the surface, the trapped internal volume 87 and pressure in the tool 50 can be relieved via the floating piston 116 of the primary venting valve 110. Because the floating piston 116 references external hydrostatic pressure, the piston 116 expands in response to the differential created from the trapped volume/pressure internally. This system is expected to dissipate/absorb 16,000 psi.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A setting tool used on tubing and activated by applied tubing pressure behind a deployed plug to set a liner hanger in a borehole, the liner hanger having a hanger bore with at least one inlet port, the at least one inlet port disposed in fluid communication with a hydraulic setting mechanism for the liner hanger, the setting tool comprising:

a tool body disposed on the tubing and being configured to removably position in the hanger bore of the line hanger, the tool body having a tool bore for borehole fluid, a stinger portion of the tool body being configured to seal inside the hanger bore and having at least one outlet port, the at least one outlet port being configured to be positioned in fluid communication with the at least one inlet port in the hanger bore of the liner hanger;

a bonnet disposed on the tool body and containing a first volume, the first volume configured to hold an actuation fluid separate from the borehole fluid;

an actuator piston disposed in the tool bore and having a second volume defined therewith, the second volume configured to hold the actuation fluid, the at least one outlet port being configured to communicate the second volume with the at least one inlet port of the hanger;

a check valve disposed on the tool body and being configured to communicate the actuation fluid from the first volume to the second volume; and an actuator seat associated with the actuator piston and configured to engage the deployed plug, the actuator piston being configured to move with movement in response to the applied tubing pressure behind the deployed plug engaged in the actuator seat, the actuator piston in response to the movement being configured to intensify the applied tubing pressure as intensified pressure on the actuation fluid in the second volume communicated from the at least one outlet port of the tool body, to the at least one inlet port of the liner hanger, and to the hydraulic setting mechanism for the liner hanger, wherein the actuator piston comprises a first temporary connection with the tool bore, the first temporary connection having a first connected state configured to prevent the movement of the actuator piston, the first temporary connection having a first unconnected state in response to a first predetermined force, the first temporary connection in the first unconnected state being configured to allow the movement of the actuator piston in response to the applied tubing pressure behind the deployed plug engaged in the actuator seat; and wherein the actuator piston comprises a second temporary connection with the tool bore, the second temporary connection having a second connected state configured to prevent an increase in the second volume, the second temporary connection having a second unconnected state in response to a second predetermined force, the second temporary connection in the second unconnected state being configured to allow the increase in the second volume.

2. The setting tool of claim 1, further comprising a venting valve disposed on the tool body and being configured to relieve the intensified pressure of the actuation fluid above a predetermined threshold in the second volume to the first volume.

3. The setting tool of claim 2, wherein the venting valve comprises a port disposed in the tool body and being openable to communicate the second volume to the first volume; wherein the port comprises a shearable pin; and wherein the venting valve comprises a venting valve piston disposed in pressure communication between the second volume and the first volume, the venting valve piston being movable to shear the shear pin from the port in response to the intensified pressure in the second volume exceeding the predetermined threshold.

4. The setting tool of claim 3, wherein the venting valve comprises a piston chamber disposed in communication between the second volume and the port, the venting valve piston being movable in the piston chamber relative to the shearable pin in response to a pressure differential, the venting valve piston in a first condition being disengaged with the shearable pin and preventing fluid communication from the second volume to the port, the venting valve piston in a second condition being engaged with the port and permitting fluid communication from the second volume to the port.

5. The setting tool of claim 4, wherein the venting valve piston comprises:

a cylindrical body disposed in the piston chamber;

inner and outer annular seal disposed on the cylindrical body and being configured to seal with the piston chamber; and a biasing element disposed in the piston chamber and biasing the cylindrical body therein.

6. The setting tool of claim 1, wherein the check valve comprises:

a piston chamber disposed in communication between the first and second volumes and having a chamber seat disposed therein; and a check valve piston being movable in the piston chamber relative to the chamber seat in response to a pressure differential, the check valve piston in a closed position being engaged with the chamber seat and preventing fluid communication from the second volume to the first volume, the check valve piston in an opened condition being disengaged from the chamber seat and permitting fluid communication from the first volume to the second volume.

7. The setting tool of claim 6, wherein the check valve piston comprises:

a cylindrical body disposed in the piston chamber;

a first annular seal disposed on the cylindrical body and being configured to seal with the chamber seat;

a second annular seal disposed on the cylindrical body and being sealed in sliding engagement with the piston chamber; and a biasing element disposed in the piston chamber and biasing the cylindrical body toward the chamber seat.

8. The setting tool of claim 1, wherein the actuator seat comprises a lock being configured to hold the actuator seat in the tool bore and being releasable in response to a predetermined threshold of the applied tubing pressure behind the deployed plug engaged in the actuator seat.

9. The setting tool of claim 1, wherein the actuator piston comprises a biasing element disposed in the second volume between a first shoulder of the tool bore and a second shoulder of the actuator piston, the biasing element being configured to resist the movement of the second shoulder of the actuator piston toward the first shoulder.

10. The setting tool of claim 1, wherein the actuator piston comprises seals disposed thereabout and sealed against the tool bore;

wherein the stinger portion of the tool body comprises a pack-off assembly having first and second annular seals sealed inside the hanger bore, the first and second annular seals isolating the at least one outlet port of the tool bore with the at least one inlet port of the hanger bore;

wherein the stinger portion comprises a releasable connection inside the hanger bore, the releasable connection in an engaged condition having locking dogs engaged with the hanger bore, the releasable connection in an unengaged condition having the locking dogs disengaged from the hanger bore; and/or wherein the actuator seat comprises an expandable seat being configured to release the deployed plug from engagement therewith in response to a predetermined threshold of the applied tubing pressure.

11. A setting tool used on tubing and activated by applied tubing pressure behind a deployed plug to set a liner hanger in a borehole, the liner hanger having a hanger bore with at least one inlet port, the at least one inlet port disposed in fluid communication with a hydraulic setting mechanism for the liner hanger, the setting tool comprising:

a tool body disposed on the tubing and being configured to removably position in the hanger bore of the line hanger, the tool body having a tool bore for borehole fluid, a stinger portion of the tool body being configured to seal inside the hanger bore and having at least one outlet port, the at least one outlet port being configured to be positioned in fluid communication with the at least one inlet port in the hanger bore of the liner hanger;

a bonnet disposed on the tool body and containing a first volume, the first volume configured to hold an actuation fluid separate from the borehole fluid;

an actuator piston disposed in the tool bore and having a second volume defined therewith, the second volume configured to hold the actuation fluid, the at least one outlet port being configured to communicate the second volume with the at least one inlet port of the hanger;

a check valve disposed on the tool body and being configured to communicate the actuation fluid from the first volume to the second volume;

an actuator seat associated with the actuator piston and configured to engage the deployed plug, the actuator piston being configured to move with movement in response to the applied tubing pressure behind the deployed plug engaged in the actuator seat, the actuator piston in response to the movement being configured to intensify the applied tubing pressure as intensified pressure on the actuation fluid in the second volume communicated from the at least one outlet port of the tool body, to the at least one inlet port of the liner hanger, and to the hydraulic setting mechanism for the liner hanger; and a venting valve disposed on the tool body and being configured to relieve the intensified pressure of the actuation fluid above a predetermined threshold in the second volume to the first volume, wherein the venting valve comprises:

a port disposed in the tool body and being openable to communicate the second volume to the first volume, the port comprising a shearable pin; and a venting valve piston disposed in pressure communication between the second volume and the first volume, the venting valve piston being movable to shear the shear pin from the port in response to the intensified pressure in the second volume exceeding the predetermined threshold.

12. The setting tool of claim 11, wherein the actuator piston comprises a first temporary connection with the tool bore, the first temporary connection having a first connected state configured to prevent movement of the actuator piston, the first temporary connection having a first unconnected state in response to a first predetermined force, the first temporary connection in the first unconnected state being configured to allow the movement of the actuator piston in response to the applied tubing pressure behind the deployed plug engaged in the actuator seat.

13. The setting tool of claim 12, wherein the actuator piston comprises a second temporary connection with the tool bore, the second temporary connection having a second connected state configured to prevent an increase in the second volume, the second temporary connection having a second unconnected state in response to a second predetermined force, the second temporary connection in the second unconnected state being configured to allow the increase in the second volume.

14. The setting tool of claim 11, wherein the venting valve comprises:

a piston chamber disposed in communication between the second volume and the port; and the venting valve piston being movable in the piston chamber relative to the shearable pin in response to a pressure differential, the venting valve piston in a first condition being disengaged with the shearable pin and preventing fluid communication from the second volume to the port, the venting valve piston in a second condition being engaged with the port and permitting fluid communication from the second volume to the port.

15. The setting tool of claim 14, wherein the venting valve piston comprises:

a cylindrical body disposed in the piston chamber;

inner and outer annular seal disposed on the cylindrical body and being configured to seal with the piston chamber; and a biasing element disposed in the piston chamber and biasing the cylindrical body therein.

16. The setting tool of claim 11, wherein the check valve comprises:

a piston chamber disposed in communication between the first and second volumes and having a chamber seat disposed therein; and a check valve piston being movable in the piston chamber relative to the chamber seat in response to a pressure differential, the check valve piston in a closed position being engaged with the chamber seat and preventing fluid communication from the second volume to the first volume, the check valve piston in an opened condition being disengaged from the chamber seat and permitting fluid communication from the first volume to the second volume.

17. The setting tool of claim 16, wherein the check valve piston comprises:

a cylindrical body disposed in the piston chamber;

a first annular seal disposed on the cylindrical body and being configured to seal with the chamber seat;

a second annular seal disposed on the cylindrical body and being sealed in sliding engagement with the piston chamber; and a biasing element disposed in the piston chamber and biasing the cylindrical body toward the chamber seat.

18. The setting tool of claim 11, wherein the actuator seat comprises a lock being configured to hold the actuator seat in the tool bore and being releasable in response to a predetermined threshold of the applied tubing pressure behind the deployed plug engaged in the actuator seat.

19. The setting tool of claim 11, wherein the actuator piston comprises a biasing element disposed in the second volume between a first shoulder of the tool bore and a second shoulder of the actuator piston, the biasing element being configured to resist the movement of the second shoulder of the actuator piston toward the first shoulder.

20. The setting tool of claim 11, wherein the actuator piston comprises seals disposed thereabout and sealed against the tool bore;

wherein the stinger portion of the tool body comprises a pack-off assembly having first and second annular seals sealed inside the hanger bore, the first and second annular seals isolating the at least one outlet port of the tool bore with the at least one inlet port of the hanger bore;

wherein the stinger portion comprises a releasable connection inside the hanger bore, the releasable connection in an engaged condition having locking dogs engaged with the hanger bore, the releasable connection in an unengaged condition having the locking dogs disengaged from the hanger bore; and/or wherein the actuator seat comprises an expandable seat being configured to release the deployed plug from engagement therewith in response to a predetermined threshold of the applied tubing pressure.

* * * * *